US005643491A

United States Patent [19]

Honkura et al.

[11] Patent Number: 5,643,491

[45] Date of Patent: Jul. 1, 1997

[54] RARE EARTH MAGNETIC POWDER, ITS FABRICATION METHOD, AND RESIN BONDED MAGNET

[75] Inventors: Yoshinobu Honkura, Aichi; Hironari Mitarai, Tokai; Chisato Mishima, Tokai; Yoshikazu Amahiro, Tokai; Hiroshi Matsuoka, Tokai; Yoshinobu Sugiura, Handa, all of Japan

[73] Assignee: Aichi Steel Works, Ltd., Japan

[21] Appl. No.: 290,819

[22] PCT Filed: Dec. 24, 1993

[86] PCT No.: PCT/JP93/01863

§ 371 Date: Aug. 17, 1994

§ 102(e) Date: Aug. 17, 1994

[87] PCT Pub. No.: WO94/15345

PCT Pub. Date: Jul. 7, 1994

[30] Foreign Application Priority Data

| | | | |
|---|---|---|---|
| Dec. 28, 1992 | [JP] | Japan | 4-359767 |
| Apr. 30, 1993 | [JP] | Japan | 5-128048 |
| Nov. 30, 1993 | [JP] | Japan | 5-329924 |

[51] Int. Cl.[6] ..... H01F 1/057

[52] U.S. Cl. ..... 252/62.54; 75/349; 148/101; 148/104; 148/302; 420/83; 420/121

[58] Field of Search ..... 148/302, 101, 148/104, 105, 122; 420/83, 121; 75/348, 349; 252/62.54

[56] References Cited

U.S. PATENT DOCUMENTS

| | | | |
|---|---|---|---|
| 4,981,532 | 1/1991 | Takeshita et al. | 148/302 |
| 5,228,930 | 7/1993 | Nakayama et al. | 148/302 |
| 5,250,206 | 10/1993 | Nakayama et al. | 252/62.54 |
| 5,395,462 | 3/1995 | Takeshita et al. | 148/302 |

FOREIGN PATENT DOCUMENTS

| | | | |
|---|---|---|---|
| 1-132106 | 5/1989 | Japan . | |
| 2-4901 | 1/1990 | Japan . | |
| 2-153507 | 6/1990 | Japan . | |
| 3-19296 | 3/1991 | Japan . | |
| 3-129702 | 6/1991 | Japan . | |
| 3-146608 | 6/1991 | Japan . | |
| 4-17604 | 1/1992 | Japan . | |
| 4-133407 | 5/1992 | Japan . | |
| 5-163510 | 6/1993 | Japan . | |
| 5-171203 | 7/1993 | Japan | 148/101 |

OTHER PUBLICATIONS

Japanese Laid–open Patent Application, H5–329924, filed Nov. 30, 1993 (Translation enclosed).

Japanese Laid–open patent application, H4–359767, filed Dec. 28, 1992 (Translation enclosed).

Japanese Laid–open patent application, H5–128048, filed Apr. 30, 1993 (Translation enclosed).

*Primary Examiner*—John Sheehan

*Attorney, Agent, or Firm*—Stroock & Stroock & Lavan, LLP

[57] ABSTRACT

In a method of fabricating an R—Fe—B based alloy magnetic powder excellent in magnetic anisotropy, and an R—Fe—B—Co based alloy magnetic powder excellent in magnetic anisotropy and temperature characteristic an R—Fe—B based alloy is subjected to hydrogenation under pressurized hydrogen gas and to dehydrogenation. Excellent magnetic properties and stable with less variation in range can be attained in an industrial fabrication by using a plurality of divided reaction tubes. Moreover, the R—Fe—B—Co based alloy magnetic powder is constituted of an aggregate structure including, as a main phase, a recrystallized structure of an extremely fine $R_2Fe_{14}B$ type phase with an average grain size of 0.05 to 3 μm, and has excellent magnetic anisotropy and temperature characteristic. Additionally, a resin bonded magnet excellent in magnetic properties and temperature characteristic is fabricated by injection molding or compression molding using the above R—Fe—B—Co based alloy magnetic powder.

10 Claims, 4 Drawing Sheets

RARE EARTH MAGNETIC POWDER, ITS FABRICATION METHOD, AND RESIN BONDED MAGNET

TECHNICAL FIELD

The present invention relates to a method of fabricating a rare earth element (hereinafter, referred to as "R")—Fe—B based alloy magnetic powder excellent in magnetic anisotropy, a method of fabricating an R—Fe—B—Co based alloy magnetic powder excellent in magnetic anisotropy and temperature characteristic, and further the powders fabricated by the above methods; and particularly to a method of stably fabricating on a large scale the above magnetic powders by suppressing deviation in magnetic characteristics.

The present invention also concerns a resin bonded magnet fabricated using the above R—Fe—B—Co alloy magnetic powder by injection molding or compression molding.

BACKGROUND ART

Recently, electronic devices have been required to be miniaturized, to be enhanced in efficiency, and to be diversified; and further, when being used for automobile, they have been required to withstand harsh environments exposed at high temperatures. Along with the above demands for the electronic devices, permanent magnets have been increasingly required to possess high performances. To meet these demands, rare earth magnets have been actively developed as permanent magnets, and particularly, in recent years, R—Fe—B based alloys have been focussed as permanent magnet materials exhibiting excellent magnetic characteristics. Thus R—Fe—B based alloy magnetic powders as the sources of the above R—Fe—B based alloys have been developed.

In particular, as a method of fabricating magnetic powders excellent in magnetic properties, there has been remarked a method of fabricating R—Fe—B based alloy magnetic powders by a method wherein R—Fe—B based alloys are subjected to hydrogen absorbing treatment, followed by dehydrogenation. For example, Japanese Patent Laid-open Gazette No. HEI 1-132106 discloses an R—Fe—B based alloy magnetic powder of this type.

The above R—Fe—B based alloy magnetic powder is fabricated by holding an ingot of an R—Fe—B based alloy mainly containing a ferro-magnetic $R_2Fe_{14}B$ type intermetallic compound (hereinafter, referred to as "$R_2Fe_{14}B$ type phase") or a powder of the ingot in a hydrogen atmosphere heated at a high temperature for hydrogen absorption; dehydrogenating at the same high temperature; and dehydrogenating the ingot or the powder thereof in a vacuum atmosphere, to thus generate the $R_2Fe_{14}B$ type phase as a ferro-magnetic phase again. The R—Fe—B based alloy magnetic powder thus obtained has an aggregate structure mainly containing an extremely fine recrystallized structure of the $R_2Fe_{14}B$ type phase having an average grain size of 0.05 to 3 μm, and has high magnetic properties.

However, the R—Fe—B based alloy magnetic powder thus fabricated by the above method, which has the excellent magnetic properties, has a disadvantage that the magnetic anisotropy is significantly reduced and is fluctuated depending on the alloy composition and crystal structure of the ingot and grain size, and on the slight fluctuation of the conditions of the treatments such as homogenization, hydrogen absorption and dehydrogenation. The reduction and deviation of the magnetic anisotropy are extremely inconvenient in the industrial mass-production, and in the worst case, they also make difficult the industrial fabrication.

To cope with this problem, for example, Japanese Patent Laid-open Gazettes Nos. HEI 3-146608 and 4-17604 disclose a technique of heating and hydrogenating an ingot or the like together with a heat reservoir having a heat keeping function, on the basis of a supposition that the deviation of the magnetic anisotropy is generated by the fluctuation in temperature due to the exothermic reaction of the hydrogen absorbing treatment. However, this technique has problems, as being pointed out by Japanese Patent Laid-open Gazette No. HEI 5-163510, such that all the surfaces of an ingot are difficult to be contacted with a heat reservoir; that a furnace must be enlarged to contain the heat reservoir; and that the sticking and entrapment of the fragments of the heat reservoir to the ingot lowers the magnetic characteristics.

On the other hand, the temperature characteristic of R—Fe—B based alloy magnets is poor; for example, the Curie point (Tc) is about 300° C. (370° C. at maximum). Japanese Patent Publication Gazette No. HEI 3-19296 discloses the improvement of the temperature characteristic of R—Fe—B based alloy magnets.

An alloy containing Co as an element for improving the temperature characteristic is pulverized to a powder of 3 to 10 μm. The powder is then compressed and sintered. In the sintered permanent magnet thus obtained, the Curie point which exhibits the improvement in the temperature characteristic is increased; however the residual magnetic flux density is reduced.

In the R—Fe—B based alloy, however, when the Co content is increased, the coercive force (iHc) tends to be reduced, and therefore, the improvement thereof is required.

Moreover, in the applicable range of the recent permanent magnets, resin bonded magnets have been come to be increasingly used, as compared with the sintered magnets. The reason for this is as follows: namely, a resin bonded magnet is fabricated by bonding a magnetic powder with an organic resin or metal based resin and thereby it is inferior in the magnetic properties to a sintered magnet of the same type; however, it is excellent in the mechanical properties to be made easy in its handling, and further, it has the high freedom of the shape. Thus the applicable range of the resin bonded magnets are increasingly expanded along with the development of the magnetic powders of this type having excellent magnetic properties.

The resin bonded magnet is formed by compression molding, extrusion molding, and injection molding. The compression molding is difficult in the integral formation with a result of the reduced freedom of the shape; however, it can increase the space factor of a magnetic powder up to 80 to 90 vol %, to thereby obtain high magnetic properties. The extrusion molding is slightly low in the space factor of a magnetic powder, for example 70 to 75 vol %; however it enhances the magnetic properties, and enables the continuous fabrication. On the other hand, the injection molding enables the integral molding, and excellent in the dimensional accuracy and the freedom of the shape; however, it is limited in the amount of a magnetic powder, for example, 60 to 65 vol % for enhancing the productivity. Accordingly, the injection molding makes it difficult to increase the magnetic performance, which has a limitation to the practical use.

However, as a resin bonded magnet using a rare earth magnetic powder excellent in magnetic properties, an Sm—Co based anisotropic magnet fabricated by injection molding is disclosed in Japanese Patent Laid-open Gazette No. HEI 2-153507, which uses a molding method in which a magnetic powder is pre-magnetized in a magnetic field higher than the molding magnetic field, whereby improving the magnetic properties.

Japanese Patent Laid-open Gazette No. HEI 3-129702 discloses an Nd—Fe—B based magnet excellent in magnetic anisotropy and corrosion resistance, which is fabricated by compression molding.

On the other hand, many techniques on the Nd—Fe—B based magnet have been disclosed on the basis of the recent research for enhancing the magnetic properties of rare earth magnets and for the reason of a problem of resources.

However, with respect to an Nd—Fe—B—Co based resin bonded magnet excellent in magnetic anisotropy and temperature characteristic using an Nd—Fe—B—Co based magnetic powder having an excellent productivity and stable quality, there have not been disclosed any technique of fabricating the above resin bonded magnet by injection molding or compression molding.

A primary object of the present invention is to provide an R—Fe—B based alloy magnetic powder excellent in magnetic anisotropy and a method of stably fabricating the above magnetic powder by suppressing variation in magnetic properties. A further object of the present invention is to provide an R—Fe—B—Co based alloy magnetic powder excellent in magnetic anisotropy and temperature characteristic and a method of stably fabricating the above magnetic powder by suppressing deviation in magnetic properties.

A still further object of the present invention is to provide an R—Fe—B—Co based resin bonded magnet excellent in magnetic anisotropy and temperature characteristic.

DISCLOSURE OF THE INVENTION

The present inventors have earnestly examined to achieve the above objects, and found the following knowledges.

Namely, to obtain an R—Fe—B based alloy magnetic powder being excellent in magnetic properties including a maximum energy product ((BH)max), coercive force (iHc) and residual magnetic flux density (Br) and a stable quality with less deviation, or an R—Fe—B—Co based alloy magnetic powder being excellent in magnetic properties including a maximum energy product ((BH)max), coercive force (iHc) and residual magnetic flux density (Br), temperature characteristic and a stable quality with less deviation, in the fabrication for the above magnetic powder by allowing an R—Fe—B based alloy or an R—Fe—B—Co based alloy to absorb hydrogen, followed by dehydrogenation; the hydrogen absorption should be made at a pressurized hydrogen atmosphere.

Hereinafter, the invention will be fully described.

(A) Fabrication Method for R—Fe—B Based Alloy Magnetic Powder (1) R—Fe—B Based Alloy The R—Fe—B based alloy basically contains R, Fe and B, and part of Fe may be substituted by one or two or more kinds of Co, Ni, V, Nb, Ta, Cu, Cr, Mn, Ti, Ga and Zr. Moreover, part of B may be substituted by one or two or more kinds of N, P, S, C, Sn, and Bi.

(2) Homogenizing Treatment

An ingot of the above R—Fe—B based alloy as a raw material is fabricated. The ingot is homogenized at a temperature between 800° and 1200° C. in an inert gas atmosphere.

The homogenizing treatment is performed for the following reason: namely, since a non-equilibrium structure such as an α-Fe phase tends to be precipitated in the R—Fe—B based alloy ingot fabricated by casting, non-equilibrium structur reduces the magnetic properties, therefore the non-equilibrium structure is eliminated prior to the hydrogen absorbing treatment and dehydrogenating treatment. Thus, using the homogenized ingot containing, substantially an $R_2Fe_{14}B$ phase as a principal phase, the magnetic properties can be significantly improved.

As the homogenizing condition, heating of the ingot in an atmosphere of an inert gas such as Ar gas is required to prevent the oxidation in the homogenizing treatment. The pressure in the inert gas atmosphere may be given by pressurization or reduction in pressure. However, in the case of reduction in pressure, the pressure must not be reduced to the extent of the pressure at which the elements constituting the composition are evaporated from the surface of the ingot. The reason for this is that the composition of the alloy is locally varied by the evaporation of the elements having high vapor pressures. Moreover, in the case of pressurization, the pressure is preferably in the range of 2 to 3 kgf/cm$^2$ in terms of equipment and treatment.

The homogenizing temperature is in the range from 800° to 1200° C. When the temperature is lower than 800° C., the homogenizing treatment requires a long period of time, which makes poor the productivity. On the other hand, when the temperature is higher than 1200° C., the ingot is unfavorably melted.

(3) Crushing Treatment

The above homogenized ingot is crushed into fragments each having a size of 5 to 10 mm. The reason for this is to make contamination such as oxidation of the raw material in the fabrication process for the R—Fe—B based alloy magnetic powder as less as possible, in order to improve the magnetic characteristics of the R—Fe—B based alloy magnetic powder finally obtained; to make easy the handling in the industrial production; and also to improve the industrial production by shortening a time required for the subsequent hydrogen absorbing and dehydrogenating processes.

Namely, when the ingot is crushed into fine powders, each of the powders as a raw material is easily contaminated due to the enlarged specific surface area thereof in addition to the contamination upon pulverization. Moreover, the handling of the powder is not easy compared with the crushed fragments.

On the other hand, the ingot can be easily handled and is free of contamination; however, it is required a long time for the subsequent hydrogen absorbing and dehydrogenating processes.

(4) Hydrogen Absorbing Treatment

Next, to change the structure of the crushed fragments as raw material thus homogenized into the recrystallized structure having an excellent magnetic properties of the R—Fe—B based alloy, hydrogen absorption (hydrogeneration) in the crushed fragments is performed at a temperature between 750° and 950° C. in a pressurized hydrogen atmosphere.

In order to allow hydrogen to be absorbed in the crushed fragments homogeneously, stably and rapidly, the hydrogen gas is required to be pressurized. This makes it possible to rapidly accelerate the change in structure of the crushed fragments, and to shorten a time for which the crushed fragments are exposed at a high temperature. The hydrogen gas pressure is preferably in the range from 1.2 to 1.6 kgf/cm$^2$. When the pressure is lower than 1.2 kgf/cm$^2$, effect of the pressurization is not obtained. On the other hand, when the pressure is greater than 1.6 kgf/cm$^2$, there occurs a problem in safety in the industrial production. In addition, when a mixed gas of hydrogen gas and inert gas is used, the partial pressure of hydrogen gas must be in the range from 1.2 to 1.6 kgf/cm$^2$.

The hydrogen absorbing temperature is in the range from 750° to 950° C. When the temperature is lower than 750° C., the change in structure is not sufficiently performed, while when the temperature is higher than 950° C., the change in structure change excessively progresses to cause the grain growth of the recrystallized phase, thus reducing the coercive force.

(5) Dehydrogenating Treatment

By perfectly dehydrogenating the crushed fragments in which hydrogen is absorbed, it is possible to obtain a high coercive force. The dehydrogenating treatment is performed at a temperature between 500° and 800° C. and under a vacuum atmosphere until the pressure of the hydrogen gas becomes to the extent of $1\times10^{-4}$ Torr or less.

The hydrogen remaining in the magnetic powder reduces the residual magnetic flux density, so that the dehydrogenation must be performed under the vacuum atmosphere until the hydrogen gas pressure becomes to the extent of $1\times10^{-4}$ Torr or less. Moreover, the reason why hydrogen pressure is set is to prevent the oxidation of the crushed fragments.

The reason why the temperature is set in the range from 500° to 800° C. is that, when the temperature is lower than 500° C., dehydrogenation is insufficient to cause hydrogen remains in the magnetic powder, which lowering the coercive force, while when the temperature is higher than 800° C., the recrystallized grain grows coarsely, to deteriorate the magnetic properties.

Each of the crushed fragments thus dehydrogenated is already changed into an aggregate of recrystallized fine powders of which structure is changed as the hydrogen collapsed matter and is in a condition tending to be easily contaminated. Accordingly, the crushed fragments held at 500° to 800° C. in the vacuum atmosphere of $1\times10^{-4}$ Torr or less is cooled to room temperature so as to prevent the contamination such as the oxidation, to thus improve the residual magnetic flux density.

The pressurized inert gas is preferably used as the atmosphere for increasing the cooling rate, and cooling is preferably made at a cooling rate of 50° C./min or more to prevent the contamination caused by condensation of the impurity gas component on the above collapsed matter in the midway of cooling.

(B) Fabrication Method for R—Fe—B—Co Based Alloy Magnetic Powder (1) R—Fe—B—Co based alloy As an R—Fe—B based alloy, an alloy ingot having the following components is used. This alloy contains, based on atomic percentage, R; 12 to 15%, B; 5 to 8%, Co; 15 to 23%, Ga; 0.3 to 2.0%, and the balance being essentially Fe and inevitable impurities.

Moreover, the above alloy may further contains one component or two or more components selected from a group consisting of Mo; 0.70% or less, V; 0.70% or less, Zr; 0.70% or less, and Ti; 0.30% or less.

Hereinafter, the reason why each component is limited will be described.

R comprises one kind or two or more kinds of rare earth elements covering Nd, and preferably consists of Nd alone or the mixture of Nd, Pr and Dy. When the content of R is less than 12%, the coercive force is reduced; while when the contents of R is more than 15%, the residual magnetic flux density is reduced.

In addition, the content of Nd is preferably in the range from 12.1 to 13.0%.

When the B content is less than 5%, the coercive force is reduced; while when the content of B is more than 8%, the residual magnetic flux density is reduced. The B content is preferably in the range from 5.0 to 7.0%.

Co is desirable to be added in a large amount for improving the Curie point; however, when it is excessively added, the coercive force is reduced. The Co content is preferably in the range from 19.5 to 21.5%.

Ga is an element for improving the magnetic anisotropy and the coercive force. When the Ga content is less than 0.3%, the above effect cannot be obtained, when the content of Ga is more than 2.0%, the anisotropy and coercive force are reduced. The Ga content is preferably in the range from 1.5 to 1.8%.

Mo, V and Zr are elements for improving the coercive force and maximum energy product. When the content of each element is more than 0.70%, the effect for the coercive force is saturated, and the maximum energy product and residual magnetic flux density are reduced. Accordingly, the content of the above element is limited to be 0.70% or less.

Ti is an element for improving the coercive force but reducing the residual magnetic flux density. Accordingly, the Ti content is limited to be 0.30% or less.

(2) Homogenizing Treatment and Crushing Treatment

The homogenizing condition is basically similar to that for (A) R—Fe—B based alloy, except that the homogenizing temperature and the size of the crushed particles for the hydrogen absorbing treatment are different by the addition of Co.

The homogenizing temperature is in the range from 1000° to 1150° C. When the temperature is lower than 1000° C., the homogenizing treatment requires a long period of time, resulting in the reduced productivity. On the other hand, when the temperature is higher than 1150° C., the above ingot is melted which is undesirable.

The above homogenized ingot is crushed into fragments with an average size of 30 mm or less. The reason for this is to enhance the magnetic properties and improve the easy handling and productivity in the industrial production by preventing the contamination such as oxidation of the raw material in the fabrication process for the R—Fe—B—Co based alloy magnetic powder.

(3) Hydrogen Absorbing Treatment

To obtain the recrystallized structure having the excellent magnetic properties of the R—Fe—B based alloy by changing the structure of the crushed fragments as the raw material thus homogenized, hydrogen is absorbed in the crushed fragments at 780° to 860° C. in a pressurized hydrogen atmosphere.

The hydrogen gas is required to be pressurized for allowing the hydrogen to be absorbed into the crushed fragments homogeneously, stably and rapidly. This makes it possible to rapidly change the structure of the crushed fragments, and to shorten a time for which the crushed fragments are exposed at a high temperature.

The hydrogen gas pressure is preferably in the range from 1.1 to 1.8 kgf/cm$^2$. When the pressure is less than 1.1 kgf/cm$^2$, the pressurizing effect is insufficient. On the other hand, when the pressure is more than 1.8 kgf/cm$^2$, the pressurizing effect is saturated, and there arises a problem of safety in the industrial production.

In the case of using the mixture of hydrogen gas and an inert gas, the partial pressure of hydrogen gas is required to be the pressure in the pressurized hydrogen atmosphere which ranges from 1.1 to 1.8 kgf/cm$^2$.

The hydrogen absorbing temperature is in the range from 780° to 860° C. When the temperature is lower than 780° C., the above change in structure is insufficient, while when the temperature is higher than 860° C., the change in structure excessively progresses, to cause the growth of the grains of the recrystallized phase, thus reducing the coercive force.

In the midway of heating from room temperature to the above temperature ranging from 780° to 860° C., the atmosphere may be either of vacuum, an inert gas such as Ar gas, or hydrogen gas.

(4) Dehydrogenating Treatment

The crushed fragments in which hydrogen is absorbed are perfectly dehydrogenated, to obtain a high coercive force. The dehydrogenating treatment is performed at a temperature between 500° to 860° C. until the hydrogen gas pressure becomes a vacuum of $1\times10^{-4}$ Torr or less.

Since hydrogen remaining in the magnetic powder lowers the residual magnetic flux density, the dehydrogenating treatment is performed until the hydrogen gas pressure becomes a vacuum of $1\times10^{-4}$ Torr or less. Moreover, the reason why the hydrogen gas is used is to prevent the oxidation of the crushed fragments during the dehydrogenating treatment.

The reason why the temperature is set in the range from 500° to 860° C. is that, when the temperature is lower than 500° C., the dehydrogenation is insufficient so that hydrogen remains in the magnetic powder to reduce the coercive force, while when the temperature is higher than 860° C., the recrystallized grain grows coarsely, to deteriorate the magnetic properties.

Moreover, the dehydrogenating treatment may be performed at a specified temperature in the range from 500° to 860° C., and further, said treatment may be performed while lowering the temperature from 860° C. within the above range.

The crushed fragments dehydrogenated are changed in structure as the hydrogen collapsed matter, which become an aggregate of recrystallized fine powder, to be easily contaminated. Accordingly, the crushed fragments, holded in an atmosphere where the hydrogen gas pressure is $1\times10^{-4}$ Torr or less and is heated between 500° to 860° C., are rapidly cooled to room temperature for preventing contamination such as oxidation, to thus enhance the residual magnetic flux density.

Using pressurized hydrogen gas or an inert gas such as Ar gas as an atmosphere for rapid cooling after dehydrogenating treatment, the cooling rate can be enhanced. Moreover, to prevent the contamination of the hydrogen collapsed matter due to the condensation of impurity gas component on the collapsed matter in the midway of cooling, it is desirable to perform the cooling at a cooling rate of 30° C./min or more.

(5) Apparatus for Hydrogen Absorbing Treatment and Dehydrogenating Treatment (hereinafter, referred to as "present apparatus")

It is required to control the variation in temperature accompanied with the exothermic reaction in the hydrogen absorbing treatment and endothermic reaction in dehydrogenating treatment, variation in flow rate of hydrogen gas, and variation in hydrogen gas pressure. The variation in the magnetic properties of the resulted product can be reduced by the above control, which enables the industrial production.

A raw material holding portion in which an alloy magnetic raw material such as crushed particles or crushed fragments is constituted of a plurality of reaction tubes for folding the crushed fragments by lots.

The present apparatus includes a plurality of reaction tubes, a single furnace provided with a temperature controller for holding the same temperature for the reaction tubes, a single hydrogen supply system for supplying a specified amount of hydrogen gas and holding a specified pressure of the gas, and a single vacuum pump system for evacuating the hydrogen gas from a plurality of the reaction tubes. Moreover, the exterior of a plurality of the reaction tubes can be cooled by an inert gas.

In addition, the industrial hydrogen absorbing treatment and dehydrogenating treatment by the present apparatus can be applied to fabricate a rare earth magnet alloy powder accompanied with exothermic/endothermic reaction, particularly, they are required for the case where one or two or more of temperature, flow rate of hydrogen gas, and hydrogen gas pressure are controlled.

(6) R—Fe—B—Co Based Alloy Magnetic Powder

The R—Fe—B—Co based alloy magnetic powder fabricated according to the above processes has an aggregate structure comprises an extremely fine recrystallized grain structure containing a $R_2Fe_{14}B$ type ferro-magnetic phase as a principal phase thereof and having an average crystal grain size of 0.05 to 3 μm. It has excellent magnetic properties including a maximum energy product ((BH)max) of 28.5 MGOe or more, preferably, 35 MGOe or more, residual magnetic flux density (Br) of 10.8 kG or more, preferably, 12.5 kG or more, and a coercive force (iHc) of 10.0 kOe or more; and an excellent temperature characteristic including a Curie point (Tc) of 480° C.

(C) R—Fe—B—Co Based Resin Bonded Magnet (1) R—Fe—B—Co Based Resin Bonded Magnet formed by Injection Molding An R—Fe—Co—B based alloy magnetic powder of 60 to 65 vol % is blended with an organic resin or a metal binder of 35 to 40 vol %. Nylon 12 and/or nylon 6 are used as the resin. The blended material is subjected to injection molding. The injection molding may be performed in the presence of a molding magnetic field of 15 kOe or less, preferably, about 12 kOe, because the above powder is excellent in the magnetic properties and is easily oriented. Moreover, the freedom of the shape is improved for make the best use of the feature of the injection molding, which makes it possible to reduce the orientation magnetic field.

(2) R—Fe—B—Co Base Resin Bonded Magnet formed by Compression Molding

An R—Fe—Co—B based alloy magnetic powder of 80 to 90 vol % is mixed with a thermosetting resin powder of 10 to 20 vol %. As the above resin, powder of epoxy resin, acrylic resin or phenol resin is used. The mixed powder of the alloy magnetic powder and the resin powder is heated at a temperature above 20° C., preferably, at the temperature capable of obtaining the minimum viscosity of the thermosetting resin, and is subjected to compression molding in the presence of the magnetic field of 12 kOe or more. When the heating temperature is higher, the thermosetting reaction rapidly progresses, to cause insufficient orientation of the alloy magnetic powder, thus reducing the magnetic properties. Meanwhile, when the heating temperature is lower, the thermosetting reaction and the orientation of the alloy magnetic powder are made insufficient, thus reducing the magnetic properties.

BEST MODE FOR CARRYING OUT THE INVENTION

EXAMPLE 1

Example 1a

Figure 1:
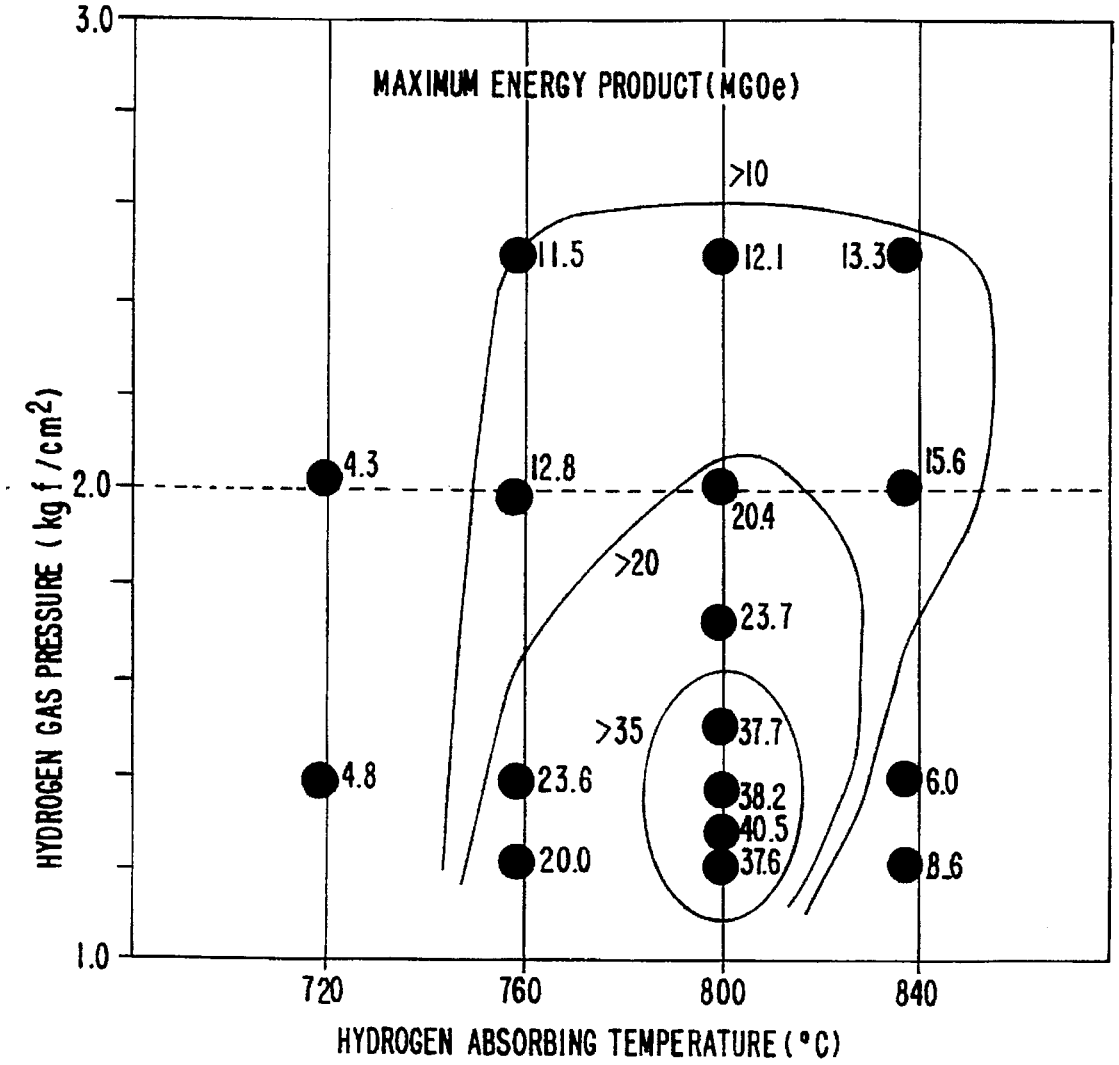
FIG. 1 is a graph showing effects of pressure of pressurized hydrogen gas and hydrogen absorbing temperature in a hydrogen absorbing treatment which are exerted on a maximum energy product.

Using Nd as a rare earth metal, each rare earth magnetic alloy ingot 1A of an Nd—Fe—Co—B based alloy mainly containing an $Nd_{12.5}Fe_{69.0}Co_{11.5}B_{6.0}Ga_{1.0}$ (atomic %) phase was fabricated by melting in a plasma arc furnace and casting. The ingot thus obtained was crushed in an Ar gas atmosphere (hereinafter, referred to as "crushing process") into fragments each having a size of about 6 to 8 mm. The crushed fragments were put in a sample holder and then charged in a tube furnace. After that, the interior of the tube furnace was evacuated into a vacuum of $1\times10^{-4}$ Torr or less, and was then filled with a hydrogen gas with each of gas pressures of 0.8, 1.0, 1.2, 1.4 and 1.6 kgf/cm$^2$. Thus, in the tube furnace, the above crushed fragments were subjected to a hydrogen absorbing treatment for 3 hr at each of holding temperatures of 600°, 700°, 750°, 800°, 850°, 900°, 950° and 1000° C. while holding the above gas pressure.

Subsequently, the resultant crushed fragments were subjected to a dehydrogenating treatment for 0.5 hr at 800° C. under a vacuum atmosphere until the pressure of the hydrogen gas becomes to the extent of $5\times10^{-5}$ Torr. After that, the dehydrogenated crushed fragments were cooled to room temperature for about 10 min using an argon gas of 1.2 kgf/cm$^2$. The aggregate (collapsed matter) composed of fine powder obtained by the above treatments was released in a mortar to a fine powder having an average particle size of 25 to 250 μm. The magnetic properties of the magnetic powder thus obtained were measured, which gave the results shown in Tables 1-1 and 1-2. In the test, the measurement was made using a VSM (Vibrating Sample Magnetometer).

As will be apparent from Tables 1-1 and 1-2, the magnetic properties are improved by the hydrogen absorbing treatment made in the atmosphere of the hydrogen gas pressurized to a pressure of 1.2 kgf/cm$^2$ or more.

Example 1b

Using Nd as a rare earth metal, each rare earth magnetic alloy ingot 1B of an Nd—Fe—Co—B based alloy mainly containing an $Nd_{12.5}Fe_{67.0}Co_{11.5}B_{6.0}Ga_{3.0}$ (atomic %) phase was fabricated by melting in a plasma arc furnace and casting. The ingot thus obtained was crushed in an Ar gas atmosphere into fragments each having a size of about 6 to 8 mm. The crushed fragments were put in a sample holder and then charged in a tube furnace. After that, the interior of the tube furnace was evacuated into a vacuum of $1\times10^{-4}$ Torr or less, and was then filled with a hydrogen gas with a gas pressures of 1.2 kgf/cm$^2$. Thus, in the tube furnace, the above crushed fragments were subjected to a hydrogen absorbing treatment for 3 hr at 800° C. while holding the above gas pressures.

Subsequently, the resultant crushed fragments were subjected to a dehydrogenating treatment for 0.5 hr at 800° C. under a vacuum atmosphere until the pressure of the hydrogen gas becomes to the extent of each of vacuums of 1.0, $1\times10^{-1}$, $1\times10^{-2}$, $1\times10^{-3}$, $1\times10^{-4}$, and $1\times10^{-5}$ Torr. After that the dehydrogenated crushed fragments were cooled to room temperature for about 10 min using an argon gas of 1.2 kgf/cm$^2$ .

TABLE 1-1

| | Hydrogen Absorbing Condition | | Magnetic Properties | | |
|---|---|---|---|---|---|
| Sample | Hydrogen gas pressure (kgf/cm$^2$) | Holding temperature (°C.) | Coercive force iHc (kOe) | Maximum energy product BHmax (MGOe) | Residual magnetic flux density Br (kG) |
| 1A11 | 0.8 | 600 | 2.5 | — | 3.0 |
| 1A12 | | 700 | 3.5 | — | 3.5 |
| 1A13 | | 750 | 5.3 | — | 4.2 |
| 1A14 | | 800 | 8.0 | — | 4.3 |
| 1A15 | | 850 | 7.4 | — | 5.5 |
| 1A16 | | 900 | 5.5 | — | 6.2 |
| 1A17 | | 950 | 3.9 | — | 5.1 |
| 1A18 | | 1000 | 2.3 | — | 3.0 |
| 1A21 | 1.0 | 600 | 3.1 | — | 4.0 |
| 1A22 | | 700 | 4.5 | — | 4.6 |
| 1A23 | | 750 | 7.0 | — | 5.5 |
| 1A24 | | 800 | 10.2 | — | 5.7 |
| 1A25 | | 850 | 9.4 | — | 7.1 |
| 1A26 | | 900 | 7.2 | — | 7.9 |
| 1A27 | | 950 | 5.0 | — | 6.6 |
| 1A28 | | 1000 | 2.9 | — | 3.4 |
| 1A31 | 1.2 | 600 | 3.5 | 2.4 | 4.4 |
| 1A32 | | 700 | 5.0 | 3.8 | 5.1 |
| 1A33 | | 750 | 7.8 | 8.0 | 6.1 |
| 1A34 | | 800 | 11.5 | 8.5 | 6.3 |
| 1A35 | | 850 | 10.5 | 12.6 | 7.8 |
| 1A36 | | 900 | 8.0 | 15.7 | 8.7 |
| 1A37 | | 950 | 5.5 | 11.1 | 7.3 |
| 1A38 | | 1000 | 3.2 | 1.2 | 3.8 |
| 1A41 | 1.4 | 600 | 3.3 | — | 4.2 |
| 1A42 | | 700 | 4.8 | — | 4.8 |
| 1A43 | | 750 | 7.5 | — | 5.6 |
| 1A44 | | 800 | 11.1 | — | 6.0 |
| 1A45 | | 850 | 10.0 | — | 7.5 |
| 1A46 | | 900 | 7.6 | 13.1 | 8.3 |
| 1A47 | | 950 | 5.3 | — | 7.0 |
| 1A48 | | 1000 | 3.0 | — | 3.6 |

TABLE 1-2

| | Hydrogen Absorbing Condition | | Magnetic Properties | | |
|---|---|---|---|---|---|
| Sample | Hydrogen gas pressure (kgf/cm$^2$) | Holding temperature (°C.) | Coercive force iHc (kOe) | Maximum energy product BHmax (MGOe) | Residual magnetic flux density Br (kG) |
| 1A51 | 1.6 | 600 | 3.2 | — | 4.1 |
| 1A52 | | 700 | 4.6 | — | 4.8 |
| 1A53 | | 750 | 7.2 | — | 5.7 |
| 1A54 | | 800 | 10.4 | 6.5 | 5.9 |
| 1A55 | | 850 | 9.6 | — | 7.2 |
| 1A56 | | 900 | 7.5 | — | 8.1 |
| 1A57 | | 950 | 5.2 | — | 6.8 |
| 1A58 | | 1000 | 3.0 | — | 3.5 |

TABLE 1-3

| Sample | Dehydrogenating Condition Vacuum degree of hydrogen gas (Torr) | Magnetic Properties: Coercive force iHc (kOe) | Maximum energy product BHmax (MGOe) | Residual magnetic flux density Br (kG) |
|---|---|---|---|---|
| 1B1 | 1.0 | 3.4 | — | 6.0 |
| 1B2 | $1.0 \times 10^{-1}$ | 4.7 | — | 5.8 |
| 1B3 | $1.0 \times 10^{-2}$ | 5.1 | — | 6.1 |
| 1B4 | $1.0 \times 10^{-3}$ | 5.4 | — | 6.8 |
| 1B5 | $1.0 \times 10^{-4}$ | 6.8 | — | 8.6 |
| 1B6 | $1.0 \times 10^{-5}$ | 7.1 | 15.1 | 9.0 |

The aggregate (collapsed matter) composed of fine powder obtained by the above treatments was released in a mortar to a fine powder each having an average particle size of 25 to 250 μm. The magnetic properties of the magnetic powder thus obtained were examined, which gave the results shown in Table 1-3.

As will be apparent from the results, the magnetic properties are improved by the dehydrogenating treatment made in the atmosphere of a vacuum of $1\times10^{-4}$ Torr as the dehydrogenating gas pressure.

EXAMPLE 1c

Using Nd as a rare earth metal, each rare earth magnetic alloy ingot 1C of an Nd—Fe—Co—B based alloy mainly containing an $Nd_{12.0}Dy_{0.5}Fe_{70.0}Co_{11.5}B_{6.0}$ (atomic %) phase was fabricated by melting in a plasma arc furnace and casting.

The ingot thus obtained was homogenized for 20 hr at a homogenizing temperature between 600° and 1300° C. in an Ar gas atmosphere, and crushed in the crushing process into fragments each having a size of about 5 to 9 mm, which were subjected to the hydrogen absorbing treatment.

Specifically, the crushed fragments were put in a sample holder and then charged in a tube furnace. After that, the interior of the tube furnace was evacuated into a vacuum of $1\times10^{-4}$ Torr or less, and was then filled with a hydrogen gas with a gas pressure of 1.2 kgf/cm$^2$. Thus, in the tube furnace, the above crushed fragments were subjected to the hydrogen absorbing treatment for 3 hr at 800° C. while holding the above gas pressure. Subsequently, the resultant crushed fragments were subjected to a dehydrogenating treatment for 0.5 hr at 800° C. under a vacuum atmosphere until the pressure of the hydrogen gas becomes to the extent of a vacuum of $1\times10^{-5}$ Torr.

After that, the dehydrogenated crushed fragments were cooled to room temperature for about 10 min using an argon gas of 1.2 kgf/cm$^2$. The aggregate (collapsed matter) composed of fine powder obtained by the above treatments was released in a mortar to a fine powder having an average particle size of 25 to 250 μm. The magnetic properties of the magnetic powder thus obtained were measured, which gave the results shown in Table 1-4.

As will be apparent from the results, the magnetic properties are improved by the homogenizing treatment made at a homogenizing temperature between 800° and 1200° C.

Example 1d

TABLE 1-4

| Sample | Homogenizing Condition Holding temperature (°C.) | Size of Raw Material used for Hydrogen Absorbing Treatment | Magnetic Properties: Coercive force iHc (kOe) | Maximum energy product BHmax (MGOe) | Residual magnetic flux density Br (kG) |
|---|---|---|---|---|---|
| 1C1 | 600 | Crushed fragment | 3.1 | — | 5.3 |
| 1C2 | 700 | | 4.1 | — | 5.2 |
| 1C3 | 800 | | 5.4 | — | 6.1 |
| 1C4 | 900 | | 5.6 | — | 6.5 |
| 1C5 | 1000 | | 12.1 | — | 7.8 |
| 1C6 | 1100 | | 13.0 | — | 8.0 |
| 1C7 | 1200 | | 9.5 | — | 7.2 |
| 1C8 | 1300 | | 4.8 | — | 5.9 |

Using Nd as a rare earth metal, each rare earth magnetic alloy ingot 1D of an Nd—Fe—Co—B based alloy mainly containing an $Nd_{12.5}Fe_{69.0}Co_{11.5}B_{6.0}Ga_{1.0}$ (atomic %) phase was fabricated by melting in a plasma arc furnace and casting. The ingot thus obtained was homogenized for 20 hr at 1100° C. in an Ar gas atmosphere, and crushed in an Ar gas atmosphere into fragments each having a size of about 5 to 7 mm. The crushed fragments were put in a sample holder and then charged in a tube furnace. After that, the interior of the tube furnace was evacuated into a vacuum of $1\times10^{-4}$ Torr or less, and was then filled with a hydrogen gas with a gas pressure of 1.2 kgf/cm$^2$. Thus, in the tube furnace, the above crushed fragments were subjected to the hydrogen absorbing treatment for 3 hr at 850° C. while holding the above gas pressures.

Subsequently, the resultant crushed fragments were subjected to a dehydrogenating treatment for 0.5 hr at 800° C. under a vacuum atmosphere until the pressure of the hydrogen gas becomes to the extent of $1\times10^{-5}$ Torr. After that, the dehydrogenated crushed fragments were cooled at each of five cooling rates ranging from 10° to 100° C./min in an Ar gas atmosphere of 1.2 kgf/cm$^2$.

TABLE 1-5

| Sample | Cooling Rate Condition (°C./min) | Magnetic Properties: Coercive force iHc (kOe) | Maximum energy product BHmax (MGOe) | Residual magnetic flux density Br (kG) |
|---|---|---|---|---|
| 1D1 | 10 | 8.6 | 16.5 | 9.2 |
| 1D2 | 30 | 8.5 | 17.2 | 9.8 |
| 1D3 | 50 | 9.5 | 20.2 | 10.2 |
| 1D4 | 80 | 12.5 | 28.3 | 12.3 |
| 1D5 | 100 | 10.3 | 26.5 | 11.8 |

The aggregate (collapsed matter) composed of fine powder obtained by the above treatments was released in a mortar to a fine powder having an average particle size of 25 to 250 μm. The magnetic properties of the magnetic powder thus obtained were tested, which gave the results shown in Table 1-5.

As will be apparent from the results, the magnetic properties are improved by the rapid cooling with a cooling rate of 50° C./min or more in the pressurized Ar gas atmosphere.

EXAMPLE 2

Tables 2-1, 2-3 and 2-6 show chemical compositions, treatment conditions (including the homogenizing, hydrogen absorbing and dehydrogenating conditions), and magnetic properties and a temperature characteristic of magnetic powders according to the present invention. Tables 2-2, 2-4, 2-5 and 2-7 show chemical compositions, treatment conditions, and magnetic properties and a temperature characteristic according to Comparative Examples.

In Tables 2-1 and 2-3, Samples 2A1 to 2A15 are intended to mainly examine the effect of the chemical composition, and Samples 2B1 to 2B6 are intended to mainly examine the effect of the treatment conditions.

TABLE 2-1

| | Chemical Composition (at %) | | | | | | |
|---|---|---|---|---|---|---|---|
| Sample | Nd | Dy | Pr | Co | B | Ga | Mo, V, Zr, Ti |
| 2A1 | 14.6 | | | 19.5 | 5.5 | 1.5 | |
| 2A2 | 12.5 | | | 16.5 | 6.0 | 1.0 | |
| 2A3 | 12.4 | | | 20.0 | 7.1 | 1.5 | |
| 2A4 | 12.5 | | | 20.0 | 5.0 | 1.5 | |
| 2A5 | 13.5 | | 0.5 | 20.0 | 5.3 | 1.5 | |
| 2A6 | 14.0 | 0.5 | | 20.0 | 5.5 | 1.0 | |
| 2A7 | 12.5 | | | 20.0 | 5.3 | 1.6 | 0.05Mo |
| 2A8 | 12.1 | | | 20.0 | 5.4 | 1.6 | 0.52Mo |
| 2A9 | 13.0 | 0.5 | | 20.0 | 4.9 | 1.6 | 0.16V |
| 2A10 | 12.4 | | | 20.0 | 5.5 | 1.6 | 0.60V |
| 2A11 | 12.5 | | | 20.0 | 6.0 | 1.6 | 0.03Zr |
| 2A12 | 12.0 | 0.4 | | 20.0 | 5.5 | 1.6 | 0.48Zr |
| 2A13 | 12.1 | | | 20.0 | 5.7 | 1.6 | 0.05Ti |
| 2A14 | 12.5 | | | 19.0 | 4.9 | 1.6 | 0.03Mo, 0.05Zr |
| 2A15 | 12.5 | 0.5 | 0.5 | 18.0 | 5.3 | 1.6 | 0.10V, 0.02Ti |
| 2B1 | 12.4 | | | 19.7 | 5.3 | 1.7 | |
| 2B2 | 12.5 | | | 20.8 | 5.4 | 1.6 | |
| 2B3 | 12.3 | 0.2 | | 19.8 | 4.9 | 1.6 | |
| 2B4 | 12.4 | | | 21.0 | 5.5 | 1.7 | |

TABLE 2-1-continued

| | Chemical Composition (at %) | | | | | | |
|---|---|---|---|---|---|---|---|
| Sample | Nd | Dy | Pr | Co | B | Ga | Mo, V, Zr, Ti |
| 2B5 | 12.1 | | 0.4 | 20.0 | 5.9 | 1.7 | |
| 2B6 | 12.7 | | | 19.8 | 6.2 | 1.7 | |

TABLE 2-2

| | Chemical Composition (at %) | | | | | | |
|---|---|---|---|---|---|---|---|
| Sample | Nd | Dy | Pr | Co | B | Ga | Mo, V, Zr, Ti |
| 2C1 | 11.0 | | | 20.0 | 5.8 | 1.6 | |
| 2C2 | 12.0 | | | 8.0 | 6.0 | 1.0 | |
| 2C3 | 12.0 | 0.5 | | 25.0 | 5.9 | 0.5 | |
| 2C4 | 12.5 | | | 10.0 | 4.8 | 2.5 | |
| 2C5 | 12.0 | | 0.5 | 10.0 | 7.5 | 3.0 | |
| 2C6 | 12.4 | | | 25.0 | 6.0 | 1.5 | |
| 2C7 | 12.5 | | | 20.0 | 5.5 | 0 | |
| 2C8 | 12.3 | 0.2 | | 20.0 | 2.0 | 1.5 | |
| 2C9 | 12.4 | | | 20.0 | 5.2 | 2.5 | |
| 2C10 | 15.5 | | | 20.0 | 6.0 | 3.0 | |
| 2C11 | 12.4 | | | 21.0 | 5.1 | 1.5 | 0.95Mo |
| 2C12 | 12.5 | | | 20.0 | 5.8 | 1.3 | 1.00V |
| 2C13 | 12.1 | | | 21.0 | 5.5 | 1.5 | 0.87Zr |
| 2C14 | 12.5 | | | 21.0 | 5.7 | 1.5 | 0.55Ti |
| 2D1 | 12.5 | | | 20.0 | 5.3 | 1.6 | |
| 2D2 | 12.1 | | | 20.0 | 5.2 | 1.8 | |
| 2D3 | 12.1 | 0.4 | | 19.0 | 6.0 | 1.7 | |
| 2D4 | 12.5 | 0.5 | | 21.0 | 5.9 | 1.6 | |
| 2D5 | 12.1 | | 0.3 | 21.0 | 4.9 | 1.8 | |
| 2D6 | 13.0 | | | 20.0 | 4.8 | 1.7 | |
| 2D7 | 12.4 | | | 19.7 | 5.3 | 1.7 | |
| 2D8 | 12.5 | | | 20.8 | 5.4 | 1.6 | |
| 2D9 | 12.3 | 0.2 | | 19.8 | 4.9 | 1.6 | |
| 2D10 | 12.4 | | | 21.0 | 5.5 | 1.7 | |

TABLE 2-3

| | Homogenizing Condition | Hydrogen Absorbing Condition | | | Dehydrogenating Condition | | |
|---|---|---|---|---|---|---|---|
| Sample | Holding temperature (°C.) | Holding temperature (°C.) | Holding time (Hr) | Gas pressure (kgf/cm$^2$) | Holding temperature (°C.) | Holding time (Hr) | Gas pressure (kgf/cm$^2$) |
| 2A1~2A15 | 1100 | 800 | 3.0 | 1.4 | 800 | 1.0 | $5 \times 10^{-5}$ |
| 2B1 | 1050 | 790 | 3.0 | 1.2 | 800 | 0.5 | $5 \times 10^{-5}$ |
| 2B2 | 1050 | 830 | 4.0 | 1.2 | 800 | 1.0 | $3 \times 10^{-5}$ |
| 2B3 | 1100 | 800 | 5.0 | 1.4 | 800 | 1.5 | $8 \times 10^{-5}$ |
| 2B4 | 1100 | 800 | 3.0 | 1.4 | 800 | 0.5 | $1 \times 10^{-4}$ |
| 2B5 | 1140 | 830 | 3.0 | 1.6 | 830 | 1.0 | $5 \times 10^{-5}$ |
| 2B6 | 1150 | 790 | 4.0 | 1.6 | 790 | 0.5 | $3 \times 10^{-5}$ |

TABLE 2-4

| | Homogenizing Condition | Hydrogen Absorbing Condition | | | Dehydrogenating Condition | | |
|---|---|---|---|---|---|---|---|
| Sample | Holding temperature (°C.) | Holding temperature (°C.) | Holding time (Hr) | Gas pressure (kgf/cm$^2$) | Holding temperature (°C.) | Holding time (Hr) | Gas pressure (kgf/cm$^2$) |
| 2C1 | 1050 | 800 | 3.0 | 1.2 | 800 | 1.0 | $5 \times 10^{-5}$ |
| 2C2 | 1050 | 800 | 3.0 | 1.4 | 800 | 0.5 | $5 \times 10^{-5}$ |
| 2C3 | 1100 | 800 | 3.0 | 1.6 | 800 | 1.0 | $5 \times 10^{-5}$ |
| 2C4 | 1100 | 800 | 3.0 | 1.2 | 800 | 0.5 | $5 \times 10^{-5}$ |
| 2C5 | 1100 | 800 | 3.0 | 1.4 | 800 | 1.0 | $5 \times 10^{-5}$ |
| 2C6 | 1100 | 800 | 3.0 | 1.2 | 800 | 1.0 | $5 \times 10^{-5}$ |
| 2C7 | 1100 | 800 | 3.0 | 1.4 | 800 | 1.0 | $5 \times 10^{-5}$ |

TABLE 2-4-continued

| Sample | Homogenizing Condition | Hydrogen Absorbing Condition | | | Dehydrogenating Condition | | |
|---|---|---|---|---|---|---|---|
| | Holding temperature (°C.) | Holding temperature (°C.) | Holding time (Hr) | Gas pressure (kgf/cm$^2$) | Holding temperature (°C.) | Holding time (Hr) | Gas pressure (kgf/cm$^2$) |
| 2C8 | 1100 | 800 | 3.0 | 1.6 | 800 | 1.0 | $5 \times 10^{-5}$ |
| 2C9 | 1100 | 800 | 3.0 | 1.6 | 800 | 1.0 | $5 \times 10^{-5}$ |
| 2C10 | 1100 | 800 | 3.0 | 1.2 | 800 | 1.0 | $5 \times 10^{-5}$ |
| 2C11 | 1100 | 800 | 3.0 | 1.4 | 800 | 1.0 | $5 \times 10^{-5}$ |
| 2C12 | 1100 | 800 | 3.0 | 1.4 | 800 | 1.0 | $5 \times 10^{-5}$ |
| 2C13 | 1100 | 800 | 3.0 | 1.4 | 800 | 1.0 | $5 \times 10^{-5}$ |
| 2C14 | 1100 | 800 | 3.0 | 1.4 | 800 | 1.0 | $5 \times 10^{-5}$ |

TABLE 2-5

| Sample | Homogenizing Condition | Hydrogen Absorbing Condition | | | Dehydrogenating Condition | | |
|---|---|---|---|---|---|---|---|
| | Holding temperature (°C.) | Holding temperature (°C.) | Holding time (Hr) | Gas pressure (kgf/cm$^2$) | Holding temperature (°C.) | Holding time (Hr) | Gas pressure (kgf/cm$^2$) |
| 2D1 | 1200 | 800 | 3.0 | 1.2 | 800 | 0.5 | $5 \times 10^{-5}$ |
| 2D2 | 1200 | 900 | 3.0 | 1.2 | 700 | 0.5 | $3 \times 10^{-5}$ |
| 2D3 | 1100 | 700 | 1.0 | 1.4 | 700 | 1.0 | $5 \times 10^{-5}$ |
| 2D4 | 1100 | 880 | 3.0 | 1.4 | 880 | 3.0 | $5 \times 10^{-2}$ |
| 2D5 | 850 | 870 | 3.0 | 1.2 | 850 | 1.0 | $5 \times 10^{-5}$ |
| 2D6 | 1050 | 900 | 3.0 | 1.4 | 900 | 1.0 | $5 \times 10^{-5}$ |
| 2D7 | 1100 | 800 | 0.5 | 0.8 | 800 | 0.8 | $5 \times 10^{-5}$ |
| 2D8 | 1050 | 1000 | 3.0 | 2.5 | 1000 | 2.0 | $5 \times 10^{-5}$ |
| 2D9 | 1100 | 800 | 4.0 | 1.3 | 400 | 2.0 | $5 \times 10^{-5}$ |
| 2D10 | 1100 | 800 | 3.0 | 2.0 | 800 | 2.5 | $5 \times 10^{-2}$ |

The magnetic properties and temperature characteristic thus obtained were shown in Table 2-6.

In Comparative Examples, similarly, in Tables 2—2, 2-4 and 2-5, Samples 2C1 to 2C14 are intended to mainly examine the effect of the chemical composition, and Samples 2D1 to 2B10 are intended to mainly examine the effect of the treatment condition. The magnetic properties and temperature characteristic thus obtained were shown in Table 2-7.

Using Nd as a rare earth metal, each of a rare earth magnetic alloy ingot of each Nd—Fe—B—Co based alloy of which composition is shown in Tables 2-1 and 2—2, respectively, was fabricated by melting in a plasma arc furnace and casting.

The ingot thus obtained was crushed in an Ar gas atmosphere into fragments each having a size of about 8 to 15 mm. The crushed fragments were put in sample holders and then the sample holders were charged in a tube furnace. The interior of the tube furnace was evacuated into a vacuum of $1\times10^{-4}$ Torr or less.

After that, the tube furnace was filled with pressurized hydrogen gas each of which gas pressure is shown in Tables 2-4 or 2-5.

TABLE 2-6

| Sample | Magnetic Properties | | | Temperature |
|---|---|---|---|---|
| | Maximum energy product (BH)max (MGOe) | Residual magnetic flux density Br (kG) | Coercive force iHc (kOe) | Characteristic Curie point Tc (°C.) |
| 2A1 | 30.0 | 11.8 | 15.0 | 510 |
| 2A2 | 31.0 | 12.0 | 11.5 | 480 |
| 2A3 | 30.2 | 11.8 | 12.0 | 510 |
| 2A4 | 29.0 | 11.5 | 11.0 | 515 |
| 2A5 | 29.5 | 11.8 | 10.5 | 515 |
| 2A6 | 28.5 | 10.9 | 12.0 | 515 |
| 2A7 | 30.0 | 12.0 | 10.0 | 510 |
| 2A8 | 29.0 | 11.8 | 15.0 | 510 |
| 2A9 | 32.0 | 12.8 | 10.5 | 500 |
| 2A10 | 30.0 | 12.0 | 13.5 | 500 |
| 2A11 | 30.0 | 12.2 | 11.0 | 500 |
| 2A12 | 28.5 | 11.5 | 15.0 | 510 |
| 2A13 | 28.5 | 10.8 | 11.5 | 500 |
| 2A14 | 31.5 | 12.4 | 13.5 | 500 |
| 2A15 | 32.5 | 12.8 | 11.5 | 490 |
| 2B1 | 30.8 | 12.1 | 13.8 | 515 |
| 2B2 | 31.0 | 11.9 | 14.2 | 516 |
| 2B3 | 33.5 | 12.4 | 16.3 | 520 |
| 2B4 | 34.0 | 12.7 | 15.5 | 520 |
| 2B5 | 33.0 | 12.3 | 12.9 | 510 |
| 2B6 | 32.0 | 11.8 | 14.3 | 500 |

TABLE 2-7

| Sample | Magnetic Properties: Maximum energy product (BH)max (MGOe) | Residual magnetic flux density Br (kG) | Coercive force iHc (kOe) | Temperature: Characteristic Curie point Tc (°C.) |
|---|---|---|---|---|
| 2C1 | 12.5 | 10.2 | 3.0 | 510 |
| 2C2 | 15.8 | 9.5 | 7.0 | 400 |
| 2C3 | 12.0 | 8.3 | 4.0 | 560 |
| 2C4 | 22.1 | 10.3 | 8.0 | 420 |
| 2C5 | 15.0 | 9.0 | 10.0 | 500 |
| 2C6 | 23.0 | 10.4 | 7.0 | 560 |
| 2C7 | 14.5 | 8.5 | 6.7 | 510 |
| 2C8 | 7.0 | 8.0 | 3.8 | 510 |
| 2C9 | 21.0 | 10.8 | 5.0 | 510 |
| 2C10 | 15.0 | 9.5 | 7.5 | 510 |
| 2C11 | 18.0 | 9.0 | 14.0 | 515 |
| 2C12 | 20.0 | 10.5 | 11.0 | 510 |
| 2C13 | 17.5 | 9.2 | 12.5 | 515 |
| 2C14 | 13.0 | 8.0 | 14.0 | 520 |
| 2D1 | 11.0 | 8.0 | 2.0 | 510 |
| 2D2 | 10.0 | 5.8 | 3.5 | 510 |
| 2D3 | 18.0 | 9.8 | 7.0 | 510 |
| 2D4 | 11.8 | 11.0 | 5.0 | 510 |
| 2D5 | 12.5 | 8.5 | 3.0 | 510 |
| 2D6 | 10.0 | 7.8 | 2.0 | 510 |
| 2D7 | 14.8 | 9.3 | 4.8 | 510 |
| 2D8 | 10.5 | 8.5 | 3.5 | 510 |
| 2D9 | 16.5 | 9.5 | 8.0 | 510 |
| 2D10 | 12.5 | 9.8 | 7.0 | 510 |

Thus, in the tube furnace, the above crushed fragments were subjected to the hydrogen absorbing treatment for 0.5 to 5.0 hr at each of holding temperatures shown in Tables 2-4 or 2-5 while holding the above gas pressures.

Subsequently, the resultant crushed fragments were subjected to a dehydrogenating treatment for 0.5 to 1.0 hr at each temperature shown in Table 2-4 and 2-5 under a vacuum atmosphere until the pressure of the hydrogen gas becomes to the extent of a specified value. After that, the dehydrogenated crushed fragments were cooled to room temperature for 15 to 30 min in an Ar gas atmosphere of 1.2 $kgf/cm^2$.

The aggregate (collapsed matter) composed of fine powder obtained by the above treatments was released in a mortar to a fine powder having an average particle size of 25 to 420 μm.

The magnetic properties and temperature characteristic of the alloy magnetic powder thus obtained were measured, which gave the results shown in Tables 2-6 and 2-7. The magnetic properties of the alloy magnetic powder were measured by the following method: namely, the mixture of the alloy magnetic powder and paraffin was put in an aluminum pan having a diameter of 4.0 mm and a height of 2.5 mm, subjected to the magnetic orientation, and solidified; and then the magnetic properties were measured by means of the VSM (Vibrating Sample Magnetometer) using this mixture.

Moreover, the temperature characteristic was measured by means of the Vibrating Sample Magnetometer with the alloy magnet put in a vessel made of alumina.

As will be apparent from Table 2-6, either of the Nd—Fe—B—Co based alloy magnetic powders according to the present invention has excellent magnetic properties including the maximum energy product ((BH)max), residual magnetic flux density (Br) and coercive force (iHc), and an excellent temperature characteristic, that is, a high Curie point (Tc).

As shown in Table 2-6, in Samples 2A1–2A6 which are composed of the alloy magnetic powders containing 20% of Co together with B and Ga and which were fabricated under the treatment conditions shown in Table 2-3, the addition of Co makes it possible to improve the Curie point while preventing the reduction of the coercive force which is opposed to the improvement of the Curie point, and hence to achieve the excellent magnetic properties.

Moreover, Samples 2A7 to 2A15 are intended to examine the effect of the addition of Mo, V, Ti and Zr to the Nd—Fe—B—Co based alloy. As a result, the addition of these elements makes it possible to further improve the coercive force to the extent of 10.8 to 12.8 kOe.

Additionally, Samples 2B1 to 2B6 are intended to examine the effect of the holding temperature in the homogenizing treatment, the holding temperature, time and gas pressure in the hydrogen absorbing treatment; and the effect of the holding temperature, time and gas pressure in the dehydrogenating treatment. Even in either condition, the excellent temperature characteristic as well as the excellent magnetic properties can be achieved.

Next, Comparative Examples to the present invention will be described.

Samples 2C1 to 2C13 shown in Table 2—2 are intended to examine the effect of the chemical compositions while the treatment conditions (Samples 2C1 to 2C13 in Table 2-4) are the same as those of the present invention. As a result, the magnetic properties and temperature characteristic thus obtained are shown in Table 2-7 (Sample 2C1 to 2C13).

In Sample 2C1, since the Nd content is small, the coercive force is lowered to 3.0 kOe. Meanwhile, in Sample 2C2, since the Co content is small, the Curie point is lowered to 400° C.

In Sample 2C3, since the Co content is large, the Curie point is improved to be 560° C.; but the coercive force is lowered to 4.0 kOe. In Sample 2C4, the contents of Co and B are small and the Ga content is large, the coercive force is lowered to 8.0 kOe and the Curie point is lowered to 420° C. In Sample 2C5, since the B content is large, the residual magnetic flux density is lowered to 9.0 kG.

In Sample 2C7, since Ga is not added, the coercive force is not improved (6.7 kOe). In Sample 2C8, since the B content is small, the coercive force is lowered to 3.8 kOe. In Sample 2C9, since the Ga content is large, the coercive force is lowered to 5.0 kOe. In Sample 2C10, the contents of Nd and Ga are large, the residual magnetic flux density is lowered to 9.5 kG and the coercive force is lowered to 7.5 kOe.

In Sample 2C11 containing a large amount of Mo, Sample 2C12 containing a large amount of V, Sample 2C13 containing a large amount of Zr, and Sample 2C13 containing a large amount of Ti, the coercive force of each samples is improved, that is, in the range from 11.0 to 14.0 kOe; however, the residual magnetic flux density of each samples is lowered, that is, in the range from 8.0 to 10.5 kG.

Moreover, Samples 2D1 to 2D10 shown in Table 2—2 (Samples 2D1 to 2D10 in Table 2—2) are the samples intended to examine the treatment condition; that is, each of these samples has the chemical compositions which is the same as those of the present invention and treated by the treatment conditions shown in Table 2-5. As a result, the magnetic properties and temperature characteristic obtained are shown in Table 2-7 (Samples 2D1 to 2D10).

In Sample 2D1, since the homogenizing temperature is high, the coercive force is lowered to 2.0 k0e and the residual magnetic flux density is lowered to 8.0 kG.

In Sample 2D2, since the holding temperature in the hydrogen absorbing treatment is high, the coercive force is lowered to 3.5 kOe. Meanwhile, in Sample 2D3, since the holding temperature in the hydrogen absorbing treatment is low, the coercive force is lowered to 7.0 kOe. In Sample 2D4, the holding temperature in the hydrogen absorbing treatment is low and the gas pressure in the dehydrogenating treatment is high, the coercive force is lowered to 5.0 kOe and the residual magnetic flux density is lowered to 11.0 kG.

In Sample 2D5, since the homogenizing temperature is low, the coercive force is lowered to 3.0 kOe and the residual magnetic flux density is also lowered to 8.5 kG. In Sample 2D6, since the holding temperatures in the hydrogen absorbing treatment and the dehydrogenating treatment are high, the coercive force is lowered to 2.0 kOe and the residual magnetic flux is also lowered to 7.8 kG.

In Sample 2D7, since the gas pressure in the hydrogen absorbing treatment is low, the coercive force is lowered to 4.8 kOe and the residual magnetic flux density is also lowered to 9.3 kG. In Sample 2D8, since the gas pressure in the hydrogen absorbing treatment is increased and the holding temperatures in the hydrogen absorbing treatment and the dehydrogenating treatment are higher than those in Sample 2D6, the coercive force is lowered to 3.5 kOe and the residual magnetic flux density is also lowered to 8.5 kG.

In Sample 2D9, since the holding temperature in the dehydrogenating treatment is low, the coercive force is lowered to 8.0 kOe. In Sample 2D10, since the gas pressure in the dehydrogenating treatment is high, that is, the vacuum atmosphere is poor, the coercive force is lowered to 7.0 kOe and the residual magnetic flux density is also lowered to 9.8 kG.

EXAMPLE 3

There will be described Example 3a as a preliminary test and Example 3b as a main test which are made to specify the test conditions according to the present apparatus.

Example 3a

Each rare earth magnetic alloy ingot of an Nd—Fe—Co—B based alloy mainly containing an $Nd_{12.3}Fe_{60.1}Co_{19.8}B_{6.0}Ga_{1.8}$ (atomic %) phase was fabricated by melting in a plasma arc furnace and casting. The ingot thus obtained was homogenized for 40 hr at 1100° C. in an Ar gas atmosphere, and crushed in an Ar gas atmosphere into fragments each having a size of about 5 to 18 mm. The crushed fragments were put in a sample holder and then charged in a tube furnace. After that, the interior of the tube furnace was evacuated into a vacuum of $1\times10^{-5}$ Torr or less, and was then filled with a hydrogen gas with each gas pressure ranging from 1.2 to 2.6 kgf/cm$^2$. Thus, in the tube furnace, the above crushed fragments were subjected to the hydrogen absorbing treatment for 3 hr at a temperature from 700° to 900° C. while holding the above gas pressure. Subsequently, the resultant crushed fragments were subjected to a dehydrogenating treatment for 0.5 hr at 700° to 900° C. under a vacuum atmosphere until the pressure of the hydrogen gas becomes to the extent of $5\times10^{-5}$ Torr. After that, the dehydrogenated crushed fragments were cooled to room temperature for about 10 min in an Ar gas atmosphere of 1.2 kgf/cm$^2$. The aggregate (collapsed matter) composed of powders obtained by the above treatments was released in a mortar to a powder having an average particle size of 74 to 105 μm. The maximum energy product ((BH)max) of the magnetic powder thus obtained was measured, which gave the results shown in FIGS. 1 and 2. The above measurement was made using the same Vibrating Sample Magnetometer stated with respect to Example 2.

As will be apparent from FIG. 1, the maximum energy product ((BH)max) is greatly dependent on hydrogen absorbing temperature and hydrogen gas pressure in the hydrogen absorbing treatment, to be thus narrowed in its excellent area of the magnetic properties. Moreover, as will be apparent from FIG. 2, the maximum energy product ((BH)max) is also dependent sensitively on the temperature in the dehydrogenating treatment. Accordingly, in mass-production, it is important to control the holding temperature and the hydrogen gas pressure in the hydrogen absorbing treatment and the holding temperature in the dehydrogenating treatment.

Example 3b

Figure 3:
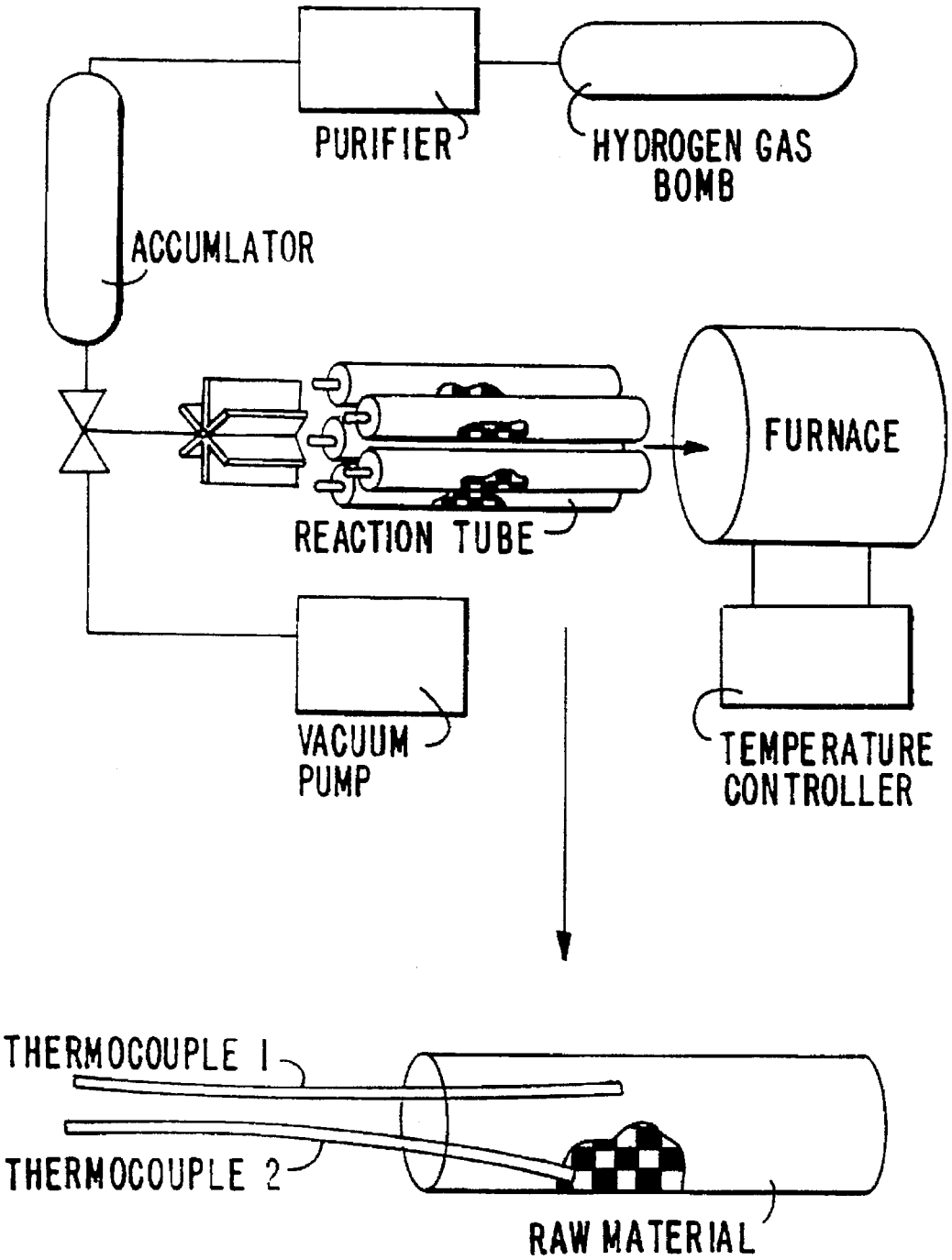
FIG. 3 is a schematic view of an apparatus used for Examples 3b and 3c.

Rare earth magnetic alloy ingots (5 kg/ingot; 4 pieces) of an Nd—Fe—Co—B based alloy mainly containing an $Nd_{12.3}Fe_{60.1}Co_{19.8}B_{6.0}Ga_{1.8}$ (atomic %) phase were fabricated using a vacuum induction furnace, respectively. Each ingot thus obtained was homogenized for 40 hr at 1100° C. in an Ar gas atmosphere, and crushed in an Ar gas atmosphere into fragments each having a size of about 10 to 30 mm. The crushed fragments were put in each reaction tube shown in FIG. 3 (hereinafter called as the present apparatus) by about 1 kg and then charged in a furnace. After that, the interior of each reaction tube was evacuated into a vacuum of $1\times10^{-4}$ Torr or less, and was then filled with a hydrogen gas of 1.3 kgf/cm$^2$. Thus, in the furnace, the above crushed fragments were subjected to the hydrogen absorbing treatment for 5 hr at 800° C. while holding the above gas pressures.

Subsequently, the resultant crushed fragments were subjected to a dehydrogenating treatment for 1.0 hr at 800° C. under a vacuum atmosphere until the pressure of the hydrogen gas becomes to the extent of $1\times10^{-5}$ Torr. After that, the dehydrogenated crushed fragments were cooled at a cooling rate of 80° C./min in an Ar gas atmosphere of 1.2 kgf/cm$^2$.

Figure 4:
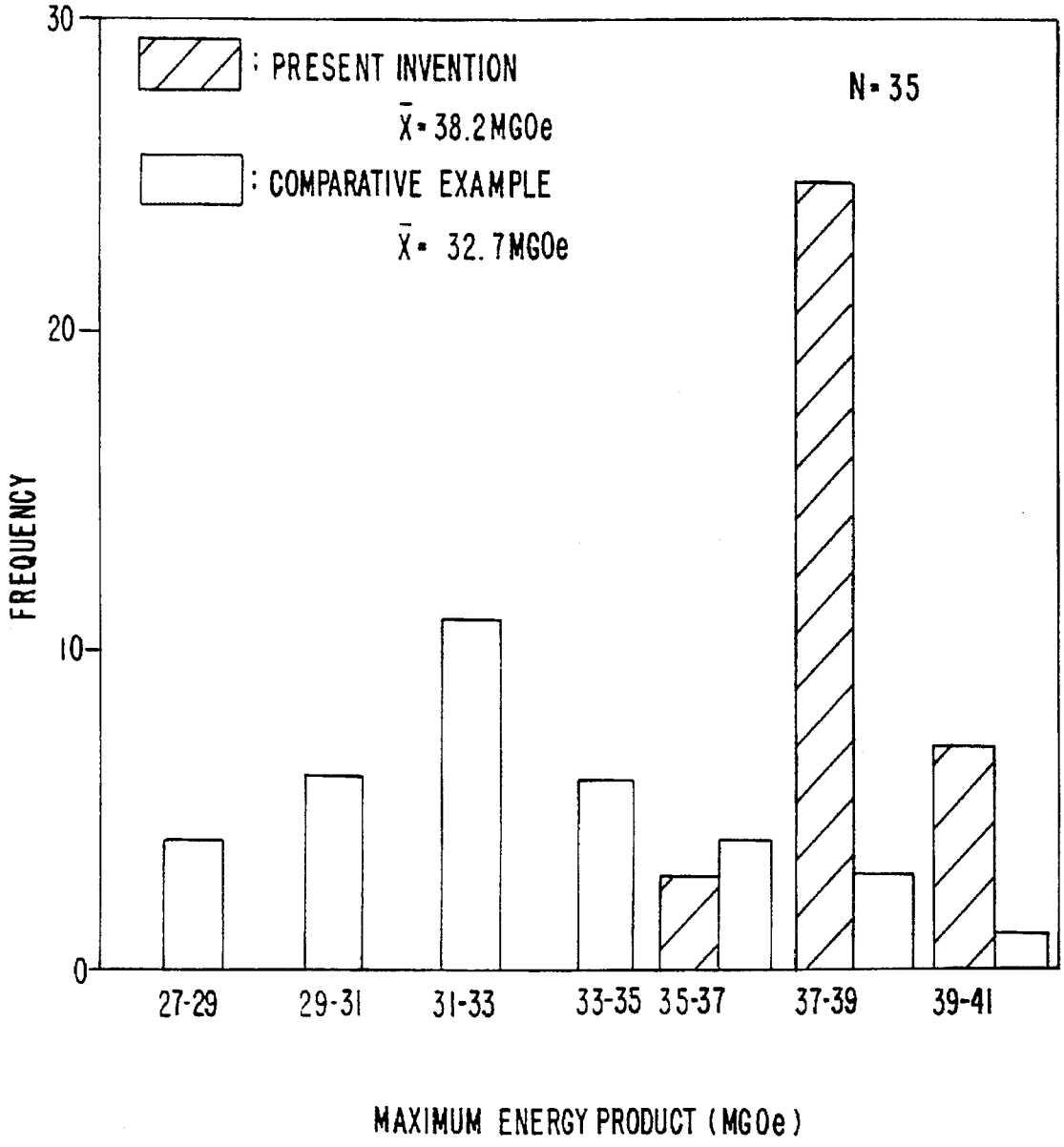
FIG. 4 is a graph showing the variation in the maximum energy product in Example 3b and Comparative Example.

From each reaction tube, five groups of sample powder were taken off. Thus, the aggregate (collapsed matter) composed of powder of each group was released in a mortar to a powder having an average particle size of 25 to 250 μm. The maximum energy product ((BH)max) of the magnetic powder in each group was measured, which gave the results shown in FIG. 4. In addition, the test method was made under the same condition as that stated with respect to Example 3a.

As the Comparative Example, the crushed fragments having the same composition as in Inventive Example of the rare earth magnetic powder accoding to the present invention were used. These crushed fragments in an amount of about 7 kg were put in one reaction tube made of a heat resisting stainless steel, and were subjected to the hydrogen absorption and dehydrogenation treatments in the furnance. These treatment conditions were the same as those in the present invention.

From the reaction tube, 35 groups of sample powder are taken off at random. Then, the aggregate (collapsed matter) composed of powder of each group was released in a mortar to a powder having an average particle size of 25 to 250 μm. The maximum energy product ((BH)max) of the magnetic powder was measured, and the results thereof were shown in FIG. 4 for comparison with those of the present invention. In addition, the test method was made under the same condition as that stated with respect to Example 3a.

Figure 2:
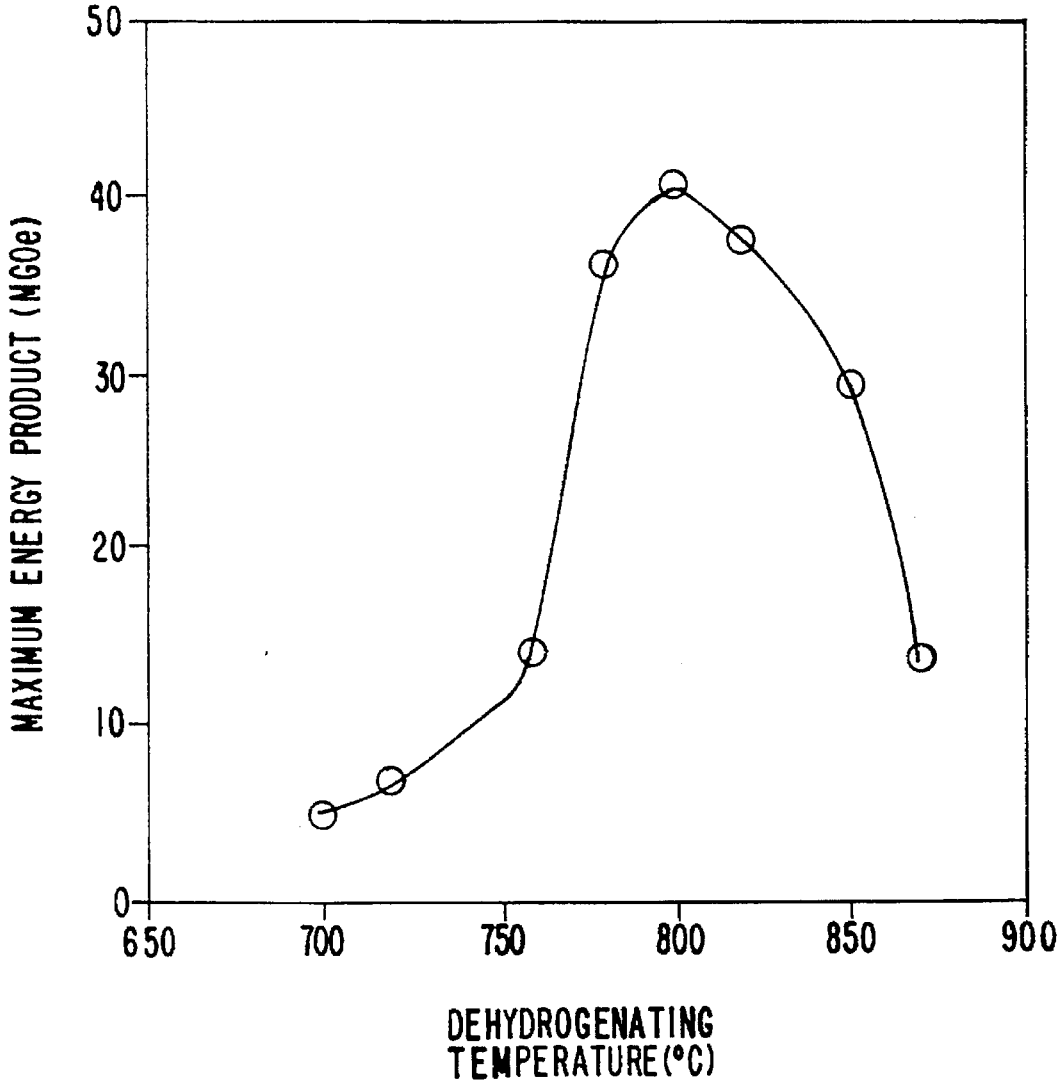
FIG. 2 is a graph showing the effect of dehydrogenating temperature exerted on a maximum energy product.

As will be apparent from FIG. 2, the average value of the maximum energy products ((BH)max) of the alloy magnetic powders obtained by the present invention reaches 38.2 MGOe, and its range of deviation is narrow, that is, in the range from 36 to 40 MGOe. On the contrary, in Comparative Example, the average value is at most 32.7 MGOe, and its range of deviation is broad, that is, in the range from 27 to 40 MGOe.

Example 3c

Table 3-1 shows the chemical compositions of the rare earth magnetic powder in accordance with the present invention, and Table 3-2 shows the magnetic properties and temperature characteristic thereof. Rare earth magnetic alloy ingots 3A to 3E (10 kg/ingot) were fabricated using a vacuum induction furnace. Each ingot thus obtained was homogenized for 40 hr at 1100° C. in an Ar gas atmosphere, and crushed in an Ar gas atmosphere into fragments each having a size of about 10 to 30 mm. The crushed fragments were put in each reaction tube according to the present apparatus shown in FIG. 3 by about 1 kg and then charged in a furnace. After that, the interior of the furnace was evacuated into a vacuum of $1\times10^{-4}$ Torr or less, and was then filled with a hydrogen gas of 1.3 kgf/cm$^2$. Then, in the furnace, the above crushed fragments were subjected to the hydrogen absorbing treatment for 5 hr at 800° C. while holding the above gas pressures.

Subsequently, the resultant crushed fragments were subjected to a dehydrogenating treatment for 1.0 hr at 800° C. under a vacuum atmosphere until the pressure of the hydrogen gas becomes to the extent of $1\times10^{-5}$ Torr. After that, the dehydrogenated crushed fragments were cooled at a cooling rate of 80° C./min in an Ar gas atmosphere of 1.2 kgf/cm$^2$.

As will be apparent from Table 3-2, the alloy magnetic powder according to the present invention exhibits the excellent magnetic properties including a maximum energy product ((BH)max) of 35 MGOe or more, a residual magnetic flux density (Br) of 12.5 kG or more, and a coercive force (iHc) of 10 kOe or more, and the excellent temperature characteristic including a Curie point (Tc) of 480° C. or more.

TABLE 3-1

| | Chemical Composition (at %) | | | | |
|---|---|---|---|---|---|
| Sample | Nd | Co | B | Ga | Fe |
| 3A | 12.1 | 19.5 | 5.3 | 1.6 | bal. |
| 3B | 12.1 | 20.5 | 6.0 | 1.8 | bal. |
| 3C | 12.3 | 21.0 | 7.0 | 1.5 | bal. |
| 3D | 12.3 | 20.0 | 5.2 | 1.6 | bal. |
| 3E | 12.8 | 20.8 | 6.0 | 1.8 | bal. |

TABLE 3-2

| | Magnetic Properties | | | Temperature |
|---|---|---|---|---|
| Sample | Maximum energy product (BH)max (MGOe) | Residual magnetic flux density Br (kG) | Coercive force iHc (kOe) | Characteristic Curie point Tc (°C.) |
| 3A | 37.5 | 13.1 | 10.5 | 510 |
| 3B | 37.0 | 13.1 | 11.8 | 520 |

TABLE 3-2-continued

| | Magnetic Properties | | | Temperature |
|---|---|---|---|---|
| Sample | Maximum energy product (BH)max (MGOe) | Residual magnetic flux density Br (kG) | Coercive force iHc (kOe) | Characteristic Curie point Tc (°C.) |
| 3C | 38.5 | 13.2 | 11.5 | 525 |
| 3D | 40.5 | 13.4 | 10.5 | 515 |
| 3E | 36.8 | 12.9 | 11.5 | 520 |

EXAMPLE 4

With respect to examples regarding to resin bonded magnets, an injection molding method will be firstly described by way of Example 4a and a compression molding method will be secondly described by way of Example 4b. The fabrication method for alloy magnetic powders used for the above molding methods will be collectively described in Example 4a.

Example 4a

Table 4-1 shows chemical compositions of rare earth alloy magnetic powders in accordance with the present invention (Samples 4A to 4E) and Comparative Examples (Samples 4F to 4H). Moreover, Table 4-2 shows the treatment conditions (including homogenizing condition, hydrogen absorbing condition, and dehydrogenating condition) for Examples in accordance with the present invention and Comparative Examples, which are required to fabricate rare earth alloy magnetic powders from alloy ingots having chemical composition of the Samples 4A to 4H.

TABLE 4-1

| Sample | Chemical Composition (at %) | | | | | |
|---|---|---|---|---|---|---|
| NO. | Nd | Dy | Pr | Co | B | Ga |
| Present Invention | | | | | | |
| 4A | 12.3 | | | 20.0 | 6.0 | 1.7 |
| 4B | 14.0 | | | 16.5 | 5.0 | 1.0 |
| 4C | 12.5 | | | 21.5 | 7.1 | 1.5 |
| 4D | 13.0 | 0.5 | | 20.0 | 5.5 | 1.0 |
| 4E | 12.1 | | 0.5 | 20.0 | 5.3 | 1.5 |
| Comparative Examples | | | | | | |
| 4F | 15.5 | | | 19.7 | 6.0 | 1.7 |
| 4G | 12.5 | | | 20.8 | 9.0 | 1.6 |
| 4H | 12.3 | 0.2 | | 19.8 | 6.0 | 0.2 |

TABLE 4-2

| Sample No. | Homogenizing Condition: Holding temperature (°C.) | Hydrogen Absorbing Condition: Holding temperature (°C.) | Hydrogen Absorbing Condition: Holding time (Hr) | Hydrogen Absorbing Condition: Gas pressure (kgf/cm$^2$) | Dehydrogenating Condition: Holding temperature (°C.) | Dehydrogenating Condition: Holding time (Hr) | Dehydrogenating Condition: Gas pressure (kgf/cm$^2$) |
|---|---|---|---|---|---|---|---|
| Present Invention | | | | | | | |
| 4A1 4B1 | 1100 | 800 | 3.0 | 1.3 | 800 | 1.0 | $5 \times 10^{-5}$ |
| 4A2 4C1 | 1050 | 790 | 3.0 | 1.2 | 800 | 0.5 | $5 \times 10^{-5}$ |
| 4A3 4D1 | 1050 | 830 | 4.0 | 1.2 | 800 | 1.0 | $3 \times 10^{-5}$ |
| 4E1 4F1 4G1 4H1 | 1100 | 800 | 5.0 | 1.4 | 800 | 1.5 | $8 \times 10^{-5}$ |
| Comparative Examples | | | | | | | |
| 4A4 | 1100 | 800 | 3.0 | 1.0 | 800 | 0.5 | $1 \times 10^{-5}$ |
| 4C2 | 1140 | 870 | 3.0 | 1.4 | 830 | 1.0 | $5 \times 10^{-5}$ |
| 4E2 | 1150 | 790 | 4.0 | 1.2 | 790 | 0.5 | $1 \times 10^{-2}$ |

TABLE 4-3

| Sample No. | Magnetic Properties: Maximum energy product (BH)max (MGOe) | Residual magnetic flux density Br (kG) | Coercive force iHc (kOe) | Coercive force bHc (kOe) | Temperature Characteristic α (%/°C.) | Temperature Characteristic β (%/°C.) |
|---|---|---|---|---|---|---|
| Present Invention | | | | | | |
| 4A1 | 13.0 | 8.3 | 10.0 | 6.3 | −0.05 | −0.51 |
| 4A2 | 13.0 | 8.3 | 9.6 | 6.2 | −0.05 | −0.52 |
| 4A3 | 12.5 | 8.2 | 10.2 | 6.1 | −0.05 | −0.51 |
| 4B1 | 10.2 | 6.9 | 11.6 | 5.5 | −0.07 | −0.53 |
| 4C1 | 10.6 | 7.4 | 11.8 | 5.6 | −0.05 | −0.51 |
| 4D1 | 10.9 | 8.1 | 10.3 | 5.7 | −0.05 | −0.52 |
| 4E1 | 12.0 | 8.1 | 9.4 | 6.2 | −0.05 | −0.52 |
| Comparative Examples | | | | | | |
| 4F1 | 7.5 | 6.6 | 10.4 | 4.8 | −0.07 | −0.57 |
| 4G1 | 6.7 | 6.0 | 10.8 | 3.1 | −0.06 | −0.5 |
| 4H1 | 4.1 | 4.3 | 12.0 | 2.8 | −0.06 | −0.5 |
| 4A4 | 8.9 | 6.5 | 9.0 | 5.3 | −0.05 | −0.57 |
| 4C2 | 4.5 | 4.7 | 11.8 | 2.8 | −0.05 | −0.56 |
| 4E2 | 8.2 | 6.6 | 9.4 | 4.6 | −0.05 | −0.56 |

Accordingly, as for the results of the magnetic properties and temperature characteristic of resin bonded magnets fabricated by the injection molding method shown in Table 4-3, Samples 4A1 to 4A3, 4B1, 4C1, 4D1 and 4E1 pertain to the Examples accoding to the present invention; and Samples 4A4, 4C2, 4E2, 4F1, 4G1 and 4H1 pertain to the Comparative Examples.

Ingots having compositions shown in Table 4-1 were fabricated by melting and casting rare earth magnetic alloys having Nd—Fe—B—Co based chemical compositions using a plasma arc furnace. Each ingot thus obtained was homogenized for 40 hr at 1080° C. in an Ar gas atmosphere.

The above ingot was crushed in an Ar gas atmosphere into fragments each having a size of about 8 to 15 mm. The crushed fragments were put in a reaction tube in accordance with the present apparatus, the interior of which was then evacuated into a vacuum of $1\times10^{-4}$ Torr or less.

After that, the interior of the reaction tube was filled with a hydrogen gas pressurized in each pressure shown in Table 4-2. Thus, in the furnace, the above crushed fragments were subjected to the hydrogen absorbing treatment for 3.0 to 5.0 hr at each holding temperature shown in Table 4-2 while holding the above gas pressure.

Subsequently, the resultant crushed fragments were subjected to a dehydrogenating treatment for 0.5 to 1.5 hr at each temperature shown in Table 4-2 under a vacuum atmosphere until the pressure of the hydrogen gas becomes to a specified vacuum at each of the holding temperature.

After that, the dehydrogenated crushed fragments were cooled to room temperature for 15 to 30 min in an Ar gas atmosphere of 1.2 kgf/cm$^2$.

The aggregate (collapsed matter) composed of the powder obtained in the above treatments was released in a mortar into a powder having an average particle size of 44 to 300 μm.

Samples 4A1 to 4H1 shown in Table 4-2 which are composed of 13 kinds of the alloy magnetic powders thus obtained, are respectively compounded by a blender, to be thus injection-molded.

First, 60 vol % of an alloy magnetic powder, nylon 12 as a binder, a silane based coupling agent and zinc stearate as a lubricant were blended, to prepare a compound.

Next, the compound was injection-molded at a molding temperature of 265° C., a mold temperature of 85° C. and a molding pressure of 85 kgf/cm$^2$. The intensity of the orientation magnetic field upon molding was 11 kOe. In addition, the molded product is formed into a rectangular parallelepiped shape having a size of 10×10×8 mm, respectively.

The molded product was magnetized in a magnetizing field of 45 kOe within an air-core coil.

The magnetic properties and temperature characteristic of the resin bonded magnet thus magnetized were measured and the results thereof are shown in Table 4-3.

In the temperature characteristic, α indicates the reversible coefficient of Br and β indicates the reversible coefficient of iHc.

As will be apparent from the results shown in Table 4-3, the resin bonded magnet in accordance with the present invention is excellent in the magnetic properties and temperature characteristic than the Comparative Examples.

Further, Table 4—4 shows the magnetic properties and temperature characteristics of Conventional Examples.

First, an Sm—Co based anisotropic resin bonded magnet was fabricated by injection molding. An $Sm_2Co_{17}$ powder of 60 vol %, nylon 12 as a binder, silane based coupling agent and zinc stearate as a lubricant were blended, to prepare a compound. The compound was injection-molded in a molding magnetic field of 15 kOe at a molding temperature of 260° C., a mold temperature of 80° C., and a molding pressure of 65 kgf/cm$^2$, to fabricate Sample 4K1. The molded product was formed in a rectangular parallelepiped shape having a size of 10×10×8 mm, respectively.

Next, an Nd—Fe—B based isotropic resin bonded magnet was fabricated by injection molding. A powder having a composition of $Nd_{14}Fe_{80}B_6$ phase was prepared by crushing a flake magnet fabricated by melt-spinning to a size of 32 mesh or less. The above magnetic powder of 60 vol %, nylon 12 as a binder, silane based coupling agent and zinc stearate as a lubricant were blended, to prepare a compound. The compound was injection-molded in a molding magnetic field of 15 kOe at a molding temperature of 280° C., a mold temperature of 85° C., and a molding pressure of 65 kgf/cm$^2$, to fabricate Sample 4K2. The molded product was formed in a rectangular parallelepiped shape having a size of 10×10×8 mm.

These molded products were magnetized in a magnetic field of 45 kOe within an air-core coil.

The magnetic properties and temperature characteristic of the resin bonded magnets thus obtained were measured, which gave the results shown in Table 4—4.

TABLE 4-4

| Sample No. | Magnetic Properties: Maximum energy product (BH)max (MGOe) | Residual magnetic flux density Br (kG) | Coercive force iHc (kOe) | Coercive force bHc (kOe) | Temperature Characteristic α (%/°C.) | β (%/°C.) |
|---|---|---|---|---|---|---|
| Conventional Examples | | | | | | |
| 4K1 | 10.0 | 6.6 | 11.0 | 5.6 | −0.04 | −0.16 |
| 4K2 | 6.0 | 5.4 | 12.0 | 4.6 | −0.10 | −0.40 |

Samples 4F1, 4G1 and 4H1 shown in Table 4-2 are intended to examine the effect of the chemical composition while the treatment conditions are the same as those of the present invention. The magnetic properties and temperature characteristic thus obtained are shown in Table 4-3 (Samples 4F1, 4G1 and 4H1).

In Sample 4F1, since the Nd content is large, the residual magnetic flux density is lowered to 6.6 kG. In Sample 4G1, since the B content is large, the residual magnetic flux density is lowered to 6.0 kG. In Sample 4H1, the Ga content is small, the maximum energy product, residual magnetic flux density and coercive force (bHc) are all low.

In Sample 4A4, since the hydrogen gas pressure in the hydrogen absorbing treatment is low, the maximum energy product is low. In Sample 4C2, since the holding temperature in the hydrogen absorbing treatment is high, the maximum energy product and coercive force are low. In Sample 4E2, since the gas pressure in the dehydrogenating treatment is high, the maximum energy product and coercive force are low.

Sample 4K1 and 4K2 are lower in the maximum energy product ((BH)max) than those of the Samples in accordance with the present invention.

Example 4b

Each of the alloy magnetic powders of Samples 4A1 to 4H1(13 kinds) shown in Table 4-2 was mixed with resin powder, and then the admixture was heated and compressed, respectively.

First, 83 vol % of the alloy magnetic powder, and 17 vol % of epoxy resin (trade name: Epicote 1004, Petrochemical Shell Epoxy Co., Ltd), hardening agent, hardening accelerator, and silane based coupling agent were mixed with each other.

Next, the mixed powder was compression-molded at a compression temperature of 160° C. and a compression pressure of 7.5 ton/cm$^2$. The intensity of the orientation magnetic field upon compression was 15 kOe. In addition, the molded product was formed in a rectangular parallelepiped shape having a size of 10×10×8 mm, respectively.

These molded products were magnetized in a magnetic field of 45 kOe within an air-core coil.

The magnetic properties and temperature characterictic of the resin bonded magnet thus magnetized was measured, and the results thereof are shown in tables 4-5.

TABLE 4-5

| Sample No. | Magnetic Properties: Maximum energy product (BH)max (MGOe) | Residual magnetic flux density Br (kG) | Coercive force iHc (kOe) | Coercive force bHc (kOe) | Temperature Characteristic α (%/°C.) | β (%/°C.) |
|---|---|---|---|---|---|---|
| Present Invention | | | | | | |
| 4A11 | 19.5 | 9.6 | 10.0 | 7.3 | −0.05 | −0.51 |
| 4A21 | 19.0 | 9.5 | 9.5 | 7.4 | −0.05 | −0.52 |
| 4A31 | 18.0 | 9.3 | 10.1 | 7.2 | −0.05 | −0.51 |
| 4B11 | 15.5 | 8.6 | 11.5 | 6.7 | −0.07 | −0.53 |
| 4C11 | 16.0 | 8.8 | 11.9 | 6.8 | −0.05 | −0.51 |
| 4D11 | 16.2 | 8.9 | 10.2 | 7.0 | −0.05 | −0.52 |
| 4E11 | 17.5 | 9.1 | 11.2 | 7.0 | −0.05 | −0.52 |
| Comparative Examples | | | | | | |
| 4F11 | 11.3 | 7.3 | 10.0 | 5.5 | −0.07 | −0.57 |
| 4G11 | 9.8 | 6.7 | 10.6 | 5.2 | −0.06 | −0.5 |
| 4H11 | 6.2 | 5.4 | 12.0 | 4.0 | −0.06 | −0.5 |
| 4A41 | 13.5 | 7.8 | 9.5 | 6.0 | −0.05 | −0.57 |
| 4C21 | 6.8 | 5.6 | 11.5 | 4.2 | −0.05 | −0.56 |
| 4E21 | 12.3 | 7.5 | 9.2 | 5.5 | −0.05 | −0.56 |

In the temperature characteristic, α indicates the reversible coefficient of Br and β indicates the reversible coefficient of iHc.

As will be apparent from the results shown in Table 4-5, the resin bonded magnet according to the present invention is excellent in the magnetic properties and temperature characteristic than the Comparative Examples.

Next, Comparative Examples will be described.

Samples 4F1, 4G1 and 4H1 shown in Table 4-2 are intended to examine the effect of the chemical compositions while the treatment conditions are the same as those in the present invention. The magnetic properties and temperature characteristic thus obtained are shown in Table 4-5.

In Sample 4F11, since the Nd content is large, the residual magnetic flux density is lowered to 7.3 kG. In Sample 4G11, the B content is large, the residual magnetic flux density is lowered to 6.7 kG. In Sample 4H11, the Ga content is small, the maximum energy product, residual magnetic flux density and coercive force (bHc) are all low.

In Sample 4A41, since the hydrogen gas pressure in the hydrogen absorbing treatment is low, the maximum energy product is low. In Sample 4C21, the holding temperature in the hydrogen absorbing treatment is high, the maximum energy product and the coercive force are low. In Sample 4E21, since the gas pressure in the dehydrogenating treatment is high, the maximum energy product and coercive force are low.

What is claimed is:

1. A method of fabricating a rare earth-iron-boron based alloy magnetic powder excellent in magnetic anisotropy comprising the steps of:

homogenizing an ingot of an alloy mainly containing R, Fe and B at a temperature ranging from 800° to 1200° C. in an inert gas atmosphere, wherein R represents a rare earth element including Y;

crushing said homogenized ingot into fragments;

subjecting said fragments to hydrogenation while holding said fragments in a hydrogen gas atmosphere pressurized to a hydrogen gas pressure of from about 1.2 to 1.6 kgf/cm$^2$ at a temperature ranging from 750° to 950° C.;

subjecting said hydrogenated fragments to dehydrogenation while holding said hydrogenated fragments at a temperature ranging from 500° to 800° C. in a vacuum atmosphere until the pressure of the hydrogen gas becomes to the extent of $1\times10^{-4}$ Torr or less; and rapidly cooling said dehydrogenated fragments.

2. A method of fabricating a rare earth-iron-boron based alloy magnetic powder excellent in magnetic anisotropy according to claim 1, wherein said dehydrogenated fragments are rapidly cooled, at a cooling rate of 50° C./min or more in a pressurized inert gas atmosphere.

3. A method of fabricating a rare earth-iron-boron-cobalt based alloy magnetic powder excellent in magnetic anisotropy and temperature characteristic comprising the steps of:

homogenizing an ingot of an alloy mainly containing R, Fe, B and Co at a temperature ranging from 1000° to 1150° C. in an inert gas atmosphere, wherein R represents a rare earth element including Nd;

crushing said homogenized ingot into fragments;

subjecting said fragments to hydrogenation while holding said fragments in a hydrogen gas atmosphere pressurized to a hydrogen gas pressure of from about 1.1 to 1.8 kgf/cm$^2$ at a temperature ranging from 780° to 860° C.;

subjecting said hydrogenated fragments to dehydrogenation while holding said hydrogenated fragments at a temperature ranging from 500° to 860° C. in a vacuum atmosphere until the pressure of the hydrogen gas becomes to the extent of $1\times10^{-4}$ Torr or less; and rapidly cooling said dehydrogenated fragments.

4. A method of fabricating a rare earth-iron-boron-cobalt based alloy magnetic powder excellent in magnetic anisotropy and temperature characteristic according to claim 4, wherein said alloy contains, in atomic percentage (at %), R; 12 to 15%

B; 5 to 8%

Co; 15 to 23%

Ga; 0.3 to 2.0%, and the balance being Fe and inevitable impurities.

5. A method of fabricating a rare earth-iron-boron-cobalt based alloy magnetic powder excellent in magnetic anisotropy and temperature characteristic according to claim 3, wherein said alloy contains, in atomic percentage (at %), R; 12 to 15%

B; 5 to 8%

Co; 15 to 23%

Ga; 0.3 to 2.0%, and further, one element or elements selected from a group consisting of Mo; 0.70% or less V; 0.70% or less Zr; 0.70% or less Ti; 0.30% or less, and the balance being Fe and inevitable impurities.

6. A rare earth-iron-boron-cobalt based alloy magnetic powder excellent in magnetic anisotropy and temperature characteristic fabricated by the method claimed in claim 4, wherein said alloy magnetic powder comprises an aggregate structure having, as a main phase, a recrystallized structure of an extremely fine $R_2Fe_{14}B$ type phase with an average grain size of 0.05 to 3 μm.

7. A rare earth-iron-boron-cobalt based alloy magnetic powder excellent in magnetic anisotropy and temperature characteristic fabricated by the method claimed in claim 5, wherein said alloy magnetic powder comprises an aggregate structure having, as a main phase, a recrystallized structure of an extremely fine $R_2Fe_{14}B$ type phase with an average grain size of 0.05 to 3 μm.

8. A rare earth-iron-boron-cobalt base alloy magnetic powder excellent in magnetic anisotropy and temperature characteristic fabricated by the method claimed in claim 4, comprising an Nd—Fe—B—Co based alloy magnetic powder including, in atomic percentage, 12.1 to 13.0% of Nd, 5.0 to 7.0% of B, 19.0 to 21.5% of Co, 1.5 to 1.8% of Ga, and the balance being Fe and inevitable impurities, wherein said alloy magnetic powder has an aggregate structure having, as a main phase, a recrystallized structure of an extremely fine $R_2Fe_{14}B$ type phase with an average grain size of 0.05 to 3 μm, and said alloy magnetic powder has magnetic properties including a maximum energy product ((BH)max) of 35.0 MGOe or more, a residual magnetic flux density (Br) of 10.8 kG or more and a coercive force (iHc) of 10.0 kOe or more, and has a temperature characteristic including a Curie point (Tc) of 480° C. or more.

9. A rare earth-iron-boron-cobalt based resin bonded magnet excellent in magnetic anisotropy and temperature characteristic, wherein said resin bonded magnet is formed by molding a mixture of a resin binder and said R—Fe—B—Co based alloy magnetic powder fabricated by the method claimed in claim 8 or said Nd—Fe—B—Co based alloy magnetic powder fabricated by the method claimed in claim 8 by way of an injection molding process.

10. A rare earth-iron-boron-cobalt based resin bonded magnet excellent in magnetic anisotropy and temperature characteristic, which is formed by molding a mixture of a resin binder and said R—Fe—B—Co based alloy magnetic powder fabricated by the method claimed in claim 8 or said Nd—Fe—B—Co based alloy magnetic powder fabricated by the method claimed in claim 8 by way of a compression molding process.

* * * * *